US010890861B1

(12) United States Patent
Nakao et al.

(10) Patent No.: US 10,890,861 B1
(45) Date of Patent: Jan. 12, 2021

(54) POWDER STORAGE HEIGHT DETECTION DEVICE AND POWDER REPLENISHING DEVICE

(71) Applicant: FUJI XEROX CO., LTD., Tokyo (JP)

(72) Inventors: Yoshihisa Nakao, Kanagawa (JP); Makoto Kanno, Kanagawa (JP); Taiyou Uehara, Kanagawa (JP); Daisuke Uchimitsu, Kanagawa (JP); Ryo Fukuno, Kanagawa (JP); Tomoyuki Hamachi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/794,748

(22) Filed: Feb. 19, 2020

(30) Foreign Application Priority Data

Sep. 25, 2019 (JP) ..... 2019-174352

(51) Int. Cl.
*G03G 15/00* (2006.01)
*G03G 15/08* (2006.01)

(52) U.S. Cl.
CPC ..... *G03G 15/0858* (2013.01); *G03G 15/0862* (2013.01)

(58) Field of Classification Search
CPC ..... G03G 15/0858; G03G 15/0862
See application file for complete search history.

(56) References Cited

U.S. PATENT DOCUMENTS 10,474,058 B2 * 11/2019 Hasegawa ..... G03G 15/0862
2017/0115597 A1 * 4/2017 Kawashima ..... G03G 15/0858

FOREIGN PATENT DOCUMENTS

JP 2016-48359 A 4/2016
JP 2016-151634 A 8/2016

* cited by examiner

*Primary Examiner* — Sophia S Chen
(74) *Attorney, Agent, or Firm* — Sughrue Mion, PLLC

(57) ABSTRACT

A powder storage height detection device includes: a main body that has a transport path along which powder is transported; a powder transport unit that is disposed to rotate in the transport path and includes a transporter provided spirally around a rotational shaft; a swinging unit that comes into contact with a surface of the powder transported in the transport path, and swings by following at least a storage height of the surface; and a detection unit that detects a state of swinging of the swinging unit. The transport unit includes a non-transport portion in which the transporter is not present, and the swinging unit is located and disposed to swing in the non-transport portion, and an upper portion located above a contact portion to be in contact with the powder is configurated by an upward convex curved surface.

19 Claims, 15 Drawing Sheets

POWDER STORAGE HEIGHT DETECTION DEVICE AND POWDER REPLENISHING DEVICE

CROSS-REFERENCE TO RELATED APPLICATIONS

This application is based on and claims priority under 35 USC 119 from Japanese Patent Application No. 2019-174352 filed on Sep. 25, 2019.

BACKGROUND

(i) Technical Field

The present disclosure relates to a powder storage height detection device and a powder replenishing device.

(ii) Related Art

Conventionally, there has been known a technique to detect the height (storage height) of the surface of stored powder, for instance, the technique disclosed in Japanese Unexamined Patent Application Publication Nos. 2016-151634 and 2016-48359.

Japanese Unexamined Patent Application Publication No. 2016-151634 describes a technique in which a float member and a light shielding plate are provided in a sub-hopper (toner reservoir) which is disposed below a toner bottle detachably attached to store developer supplied from the toner bottle and supply the stored developer to a developing unit by the drive of a supply roller, the float member being provided swingably around a shaft as a center to detect the upper surface of the toner, the light shielding plate being detected by a transmissive photo sensor and configured to swing vertically according to swing of the float member attached to the shaft.

In addition, Japanese Unexamined Patent Application Publication No. 2016-151634 states that the float member swings vertically by a cam which rotates along with an agitation shaft disposed below the float member, and even when the toner in the sub-hopper is reduced, the float member swings vertically so as not collide with an agitation plate provided in the agitation shaft for levelling the surface of the toner. Furthermore, Japanese Unexamined Patent Application Publication No. 2016-151634 states that when the toner in the sub-hopper is reduced, a state of swinging down of the float member is detected by the transmissive photo sensor via the light shielding plate.

Japanese Unexamined Patent Application Publication No. 2016-48359 describes a technique to detect the amount of toner, the technique having substantially the same components as those of Japanese Unexamined Patent Application Publication No. 2016-151634 except for the light shielding plate and the transmissive photo sensor.

In addition, Japanese Unexamined Patent Application Publication No. 2016-48359 states that a magnet is provided at the upper surface, on a free end side, of the float member which swings to an upper limit in the sub-hopper, an empty sensor which operates according to the position of the magnet is mounted at the outer side surface of the sub-hopper, and a state of swinging down of the float member due to reduced toner in the sub-hopper is detected by the empty sensor via the magnet.

SUMMARY

Aspects of non-limiting embodiments of the present disclosure relate to a powder storage height detection device and a powder replenishing device that uses the developer storage height detection device which is capable of detecting a storage height of powder without causing a reduction in the accuracy of detection due to accumulation of the powder stored in the transport path in which a powder transport unit having a spiral transporter around a rotational shaft is disposed to rotate.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder storage height detection device including:

a main body that has a transport path along which powder is transported;

a powder transport unit that is disposed to rotate in the transport path and includes a transporter provided spirally around a rotational shaft;

a swinging unit that comes into contact with a surface of the powder transported in the transport path, and swings by following at least a storage height of the surface; and a detection unit that detects a state of swinging of the swinging unit.

The transport unit includes a non-transport portion in which the transporter is not present, and the swinging unit is located and disposed to swing in the non-transport portion, and an upper portion located above a contact portion to be in contact with the powder is configurated by an upward convex curved surface.

BRIEF DESCRIPTION OF THE DRAWINGS

Exemplary embodiments of the present disclosure will be described in detail based on the following figures, wherein:

FIG. 6A is a schematic cross-sectional view illustrating the state when a swinging unit swings to a highest position, and FIG. 6B is a schematic cross-sectional view illustrating the state when the swinging unit swings to a lowest position;

FIG. 11A is a schematic perspective view illustrating the configuration of a swinging unit at a storage height detection position, and FIG. 11B is an enlarged schematic view illustrating a contact portion of the swinging unit of FIG. 11A;

FIG. 12A is a schematic perspective view illustrating the configuration of a swinging unit at a storage height detection position, and FIG. 12B is an enlarged schematic view illustrating a contact portion of the swinging unit of FIG. 12A;

FIG. 13A is a schematic cross-sectional view illustrating the state when a swinging unit swings to a highest position, and FIG. 13B is a schematic cross-sectional view illustrating the state when the swinging unit swings to a lowest position;

DETAILED DESCRIPTION

Hereinafter exemplary embodiments of the present disclosure will be described with reference to the drawings.

First Exemplary Embodiment

Figure 1:
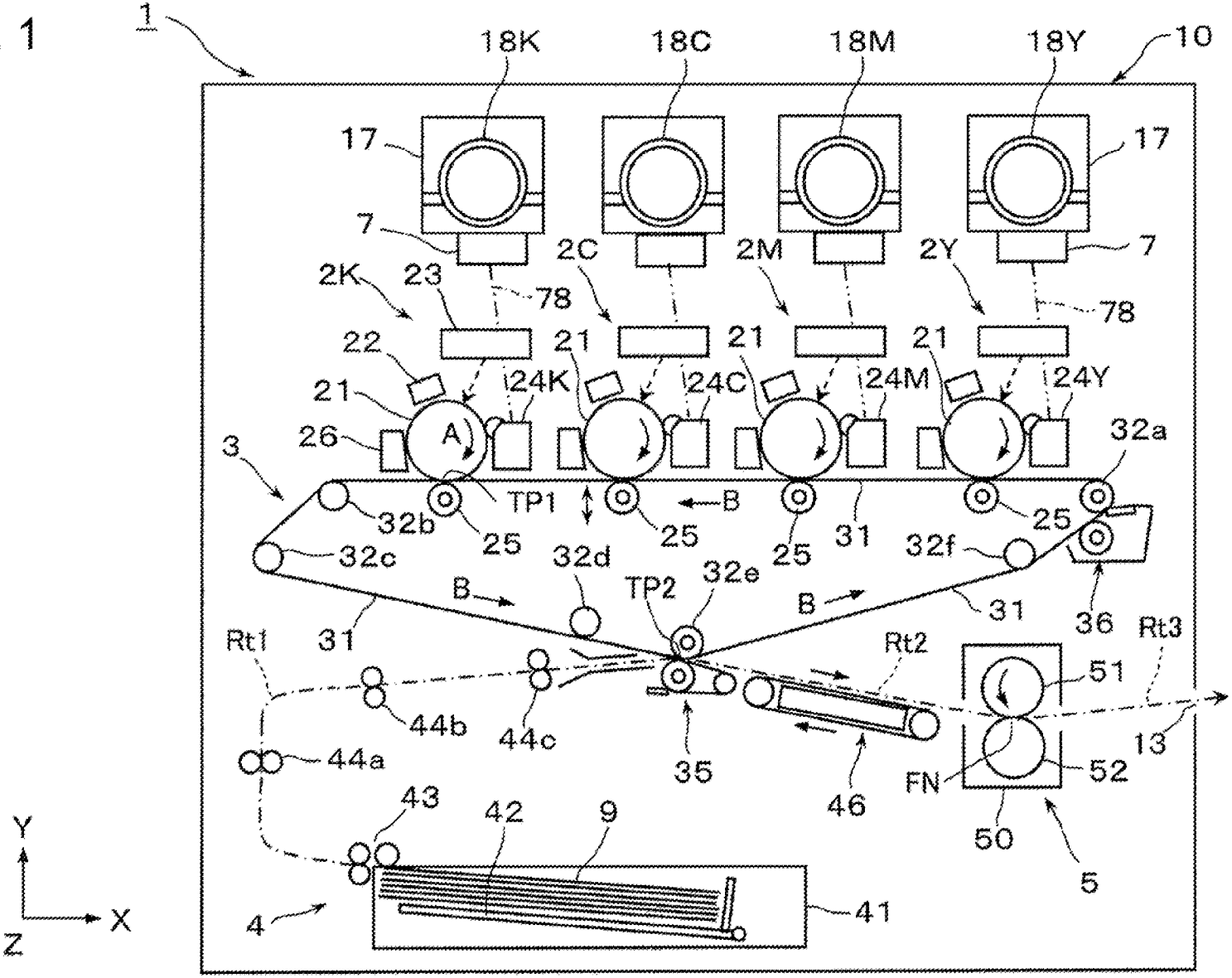
FIG. 1 is a schematic view illustrating the entire configuration of an image forming apparatus according to a first exemplary embodiment.
Figure 2:
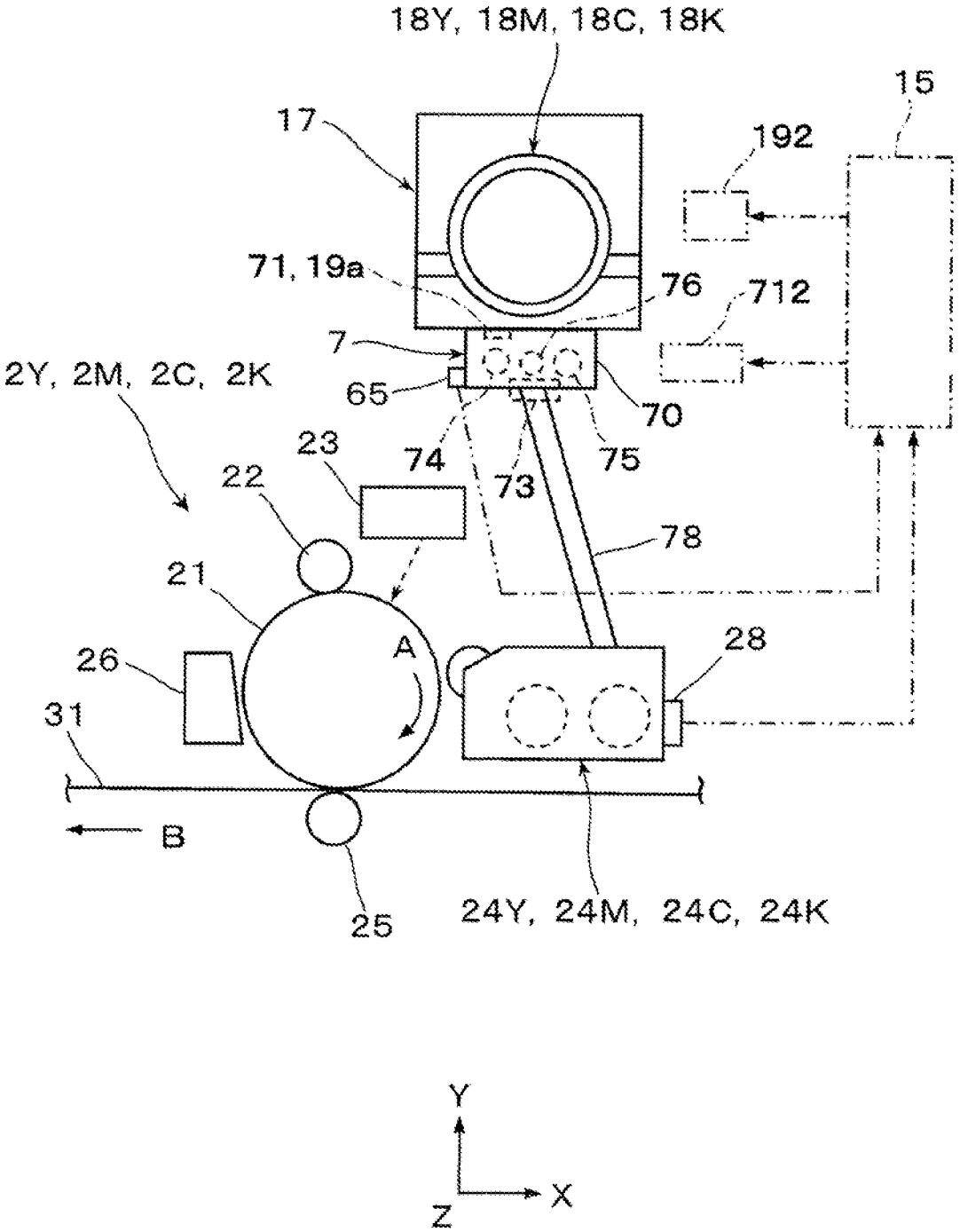
FIG. 2 is a schematic view illustrating part of the configuration of the image forming apparatus of FIG. 1.

FIGS. 1 and 2 are views illustrating an image forming apparatus 1 according to a first exemplary embodiment. FIG. 1 illustrates the entire configuration of the image forming apparatus 1, and FIG. 2 illustrates the configuration of part (primarily, an image forming device and a developer replenishing device) of the image forming apparatus 1.

The arrows labeled with the symbols X, Y, Z in the drawings such as FIG. 1 indicate the directions of width, height, and depth of three-dimensional space defined in the drawings. In each of the drawings, a circle symbol at the intersection of the arrows in the X and Y directions indicates that the Z direction is toward the vertically downward of the drawing surface.

<Configuration of Image Forming Apparatus>

The image forming apparatus 1 is an apparatus that forms an image composed of toner as a developer on a sheet of paper 9 which is an example of a recording medium. The image forming apparatus 1 in the first exemplary embodiment is implemented as a printer that forms an image corresponding to image information inputted from an external connection device such as an information terminal device, for instance.

As illustrated in FIG. 1, the image forming apparatus 1 has a housing 10 in a desired external shape, and in the internal space of the housing 10, the image forming apparatus 1 includes an image forming device 2 that forms a toner image based on image information; an intermediate transfer device 3 that temporarily holds the image formed by the image forming device 2 then secondarily transfers the image to the sheet of paper 9; a sheet feeding device 4 that stores and supplies sheets of paper 9 to be supplied to the position at which secondary transfer is performed by the intermediate transfer device 3; and a fixing device 5 that fixes a toner image secondarily transferred by the intermediate transfer device 3 to the sheet of paper 9.

Herein the image information is information on an image such as a character, a figure, a photograph, and a pattern, for instance. The housing 10 is a structure formed in a desired shape with various support members and exterior materials. The dashed-dotted line with an arrow in FIG. 1 and other figures indicates a primary transport path when the sheet of paper 9 is transported within the housing 10.

The image forming device 2 includes four image forming devices 2Y, 2M, 2C, and 2K that exclusively form toner images of four colors: yellow (Y), magenta (M), cyan (C), and black (K), respectively.

Each of the four image forming devices 2 (Y, M, C, K) has a photoreceptor drum 21 which is an example of an image carrying unit that rotates in the direction indicated by an arrow A, and the image forming device 2 is formed by disposing devices, such as a charging device 22, an exposure device 23, a developing device 24 (Y, M, C, K), a first transfer device 25, and a drum cleaning device 26 in the surroundings of the photoreceptor drum 21. In FIG. 1, the symbols 21 to 26 are labeled to the image forming device 2K for black (K) only, and part of the symbols are labeled to the image forming devices (Y, M, C) for other colors.

Among all, the charging device 22 is a device that charges the outer circumferential surface (surface allowing formation of an image) of the photoreceptor drum 21 to a desired surface potential. The exposure device 23 is a device that performs light exposure on the outer circumferential surface of the photoreceptor drum 21 based on image information, and forms an electrostatic latent image having desired color components (Y, M, C, K). The developing device 24 (Y, M, C, K) is a device that develops the electrostatic latent image formed on the outer circumferential surface of the photoreceptor drum 21 with developer (toner) corresponding predetermined colors (Y, M, C, K), and forms a toner image of the predetermined four colors, the developer being dry powder.

The first transfer device 25 is a device that electrostatically transfers the toner image of each color formed on the outer circumferential surface of the photoreceptor drum 21 to the intermediate transfer device 3 (an intermediate transfer belt 31). The drum cleaning device 26 is a device that scrapes and removes unnecessary toner and unwanted substances, such as paper powder, adhering to the outer circumferential surface of the photoreceptor drum 21 to clean the outer circumferential surface of the photoreceptor drum 21.

In these image forming devices 2 (Y, M, C, K), each location where the photoreceptor drum 21 (in a strict sense, an intermediate transfer belt 31 of the intermediate transfer device 3) and the first transfer device 25 are opposed to each other is a first transfer position TP1 at which the first transfer of a toner image is performed.

In the four image forming devices 2Y, 2M, 2C, 2K, for instance, when a command for an image forming operation to form a multi-color image in a combination of toner images of the four colors (Y, M, C, K), what is called a full-color image is received, for each photoreceptor drum 21 which rotates in the direction indicated by an arrow A in the image forming devices 2 (Y, M, C, K), a charging operation by the charging device 22, an exposure operation by the exposure device 23, a developing operation by the developing device 24 (Y, M, C, K) are performed.

Thus, each of toner images of four colors composed of the components of the four colors (Y, M, C, K) is individually formed on a corresponding photoreceptor drum 21 in the image forming devices 2Y, 2M, 2C, 2K. Subsequently, the toner images of four colors formed on the photoreceptor drums 21 are transported to the first transfer position TP1 by the rotation of the photoreceptor drums 21.

The intermediate transfer device 3 is a device configured to carry a toner image of each color by the first transfer, the toner image being formed by the image forming devices 2 (Y, M, C, K), then to transport the toner image to a position at which the second transfer is performed on the sheet of paper 9. The intermediate transfer device 3 is disposed on the lower side of the image forming devices 2 (Y, M, C, K) within the housing 10.

The intermediate transfer device 3 includes an intermediate transfer belt 31 to which a toner image is first transferred from each photoreceptor drum 21 of the image forming devices 2 (Y, M, C, K), and which carries the toner image. The intermediate transfer belt 31 is supported by multiple support rollers 32*a* to 32*f* disposed therewithin so as to pass through the first transfer positions of the image forming devices 2 (Y, M, C, K) sequentially and rotate (circumferential movement) in the direction indicated by an arrow B.

Among the support rollers, the support roller 32*a* is formed as a drive roller which is driven to rotate by receiving rotational power from a driving device (not illustrated), the support roller 32*b* is formed as a surface roller which holds a belt position (surface) immediately before or immediately after the first transfer position of the intermediate transfer belt 31 in cooperation with the support roller 32*a*, and the support roller 32C is formed as a tension roller.

In addition, the support roller 32*d* is formed as a surface roller before the second transfer of the intermediate transfer belt 31, the support roller 32*e* is formed as a second transfer backup roller, and the support roller 32*f* is formed as a surface roller after the second transfer position of the intermediate transfer belt 31 is passed. When the support roller 32*e* is formed as a roller to which a voltage for the second transfer is supplied, the voltage for the second transfer is supplied from a power supply device which is not illustrated.

The first transfer device 25 of each of the image forming devices 2 (Y, M, C, K) is disposed inwardly of the intermediate transfer device 3. The first transfer device 25 configurates part of the intermediate transfer device 3. The first transfer device 25 includes a first transfer roller, to which a first transfer current is supplied from a power supply device which is not illustrated.

A second transfer device 35 is disposed at the outer circumferential surface of a portion supported by the support roller 32*e* of the intermediate transfer belt 31. The second transfer device 35 allows the sheet of paper 9 to pass through and secondarily transfers a toner image on the intermediate transfer belt 31 to the sheet of paper 9. The second transfer device 35 includes a second transfer roller.

In addition, at the outer circumferential surface of a portion supported by the support roller 32*a* of the intermediate transfer belt 31, a belt cleaning device 36 is disposed, which is a removal unit that removes unwanted substances such as unnecessary toner adhering to the outer circumferential surface of the intermediate transfer belt 31 to clean the outer circumferential surface of the intermediate transfer belt 31.

In the intermediate transfer device 3, the location where the outer circumferential surface of the intermediate transfer belt 31 is in contact with the second transfer device 35 is a second transfer position TP2 at which the second transfer of a toner image is performed.

The sheet feeding device 4 is a device configured to store and deliver the sheets of paper 9 to be supplied to the second transfer position TP2 of the intermediate transfer device 3. The sheet feeding device 4 is disposed at a position on the lower side of the image forming devices 2 (Y, M, C, K) inside the housing 10.

The sheet feeding device 4 is formed by disposing devices such as a storage body 41 for sheets of paper, and a feeding device 43.

The storage body 41 is a storage member having a stacking plate 42 for storing multiple sheets of paper 9 stacked in a desired orientation, and is mounted to allow an operation such as drawing the storage member to the outside of the housing 10 and loading the sheets of paper 9. The feeding device 43 is a device that delivers the uppermost one of the sheets of paper 9 stacked on the stacking plate 42 of the storage body 41 one by one by sheet delivery devices such as multiple rollers.

The sheet of paper 9 may be a recording medium, such as regular paper, coated paper, or thick paper, which can be transported within the housing 10, and allows transfer and fixing of a toner image, and the quality and form of the recording medium is not particularly restricted.

A sheet feeding transport path Rt1 for transporting and supplying the sheet of paper 9 in the sheet feeding device 4 to the second transfer position TP2 is provided between the sheet feeding device 4 and the second transfer position TP2 of the intermediate transfer device 3. The sheet feeding transport path Rt1 is formed by disposing multiple transport rollers 44*a* to 44*c* that sandwich and transport the sheet of paper 9, and multiple guiding members (not illustrated) that ensure the transport space for the sheet of paper 9 and guide the transport of the sheet of paper 9.

In the intermediate transfer device 3, toner images of four colors formed on the photoreceptor drums 21 in the image forming devices 2Y, 2M, 2C, 2K undergo a first transfer operation of the first transfer device 25, and are sequentially first transferred and stacked onto the outer circumferential surface of the intermediate transfer belt 31 which rotates in the direction indicated by the arrow B, then are transported to the second transfer position TP2. After being delivered from the sheet feeding device 4 to the second transfer position TP2 at the timing of the formation and transport of the toner images, a desired sheet of paper 9 is transported through the sheet feeding transport path Rt1.

Thus, at the second transfer position TP2 of the intermediate transfer device 3, the toner images first transferred to the intermediate transfer belt 31 and transported undergo the transfer operation of the second transfer device 35, and are collectively secondarily transferred to one side of the sheet of paper 9.

The fixing device 5 is a device configured to fix a toner image to the sheet of paper 9, the toner image being secondarily transferred by the intermediate transfer device 3. The fixing device 5 is disposed at a lower position on the downstream side in the transport direction of the sheet of paper 9 from the second transfer position TP2 of the intermediate transfer device 3 within the housing 10.

The fixing device 5 is formed by disposing devices, such as a rotational body 51 for heating, and a rotational body 52 for pressurizing, in the internal space of a housing 50 provided with an introduction port and a discharge port for the sheets of paper 9.

The rotational body 51 for heating is a rotational body in a roll form or a belt-pad form, rotatable in the direction indicated by an arrow, and is heated so that the outer circumferential surface is maintained at a desired temperature by a heating unit which is not illustrated. The rotational body 52 for pressurizing is a rotational body in a roll form or a belt-pad form, which comes into contact with the rotational body 51 for heating under a desired pressure, and rotates by following the rotational body 51. The rotational body 52 for pressurizing may be heated by a heating unit.

In the fixing device 5, the location where the rotational body 51 for heating and the rotational body 52 for pressurizing are in contact with each other serves as a nip part (fixing processing part) FN that performs processing such as heating, pressurizing for fixing an unfixed toner image to the sheet of paper 9.

A relay transport path Rt2 is provided between the second transfer position TP2 of the intermediate transfer device 3 and the fixing device 5 for relaying and transporting the sheet of paper 9 after the second transfer to the fixing device 5. The relay transport path Rt2 is formed by disposing, for instance, a suction belt transport device 46.

A discharge transport path Rt3 for transporting the sheet of paper 9 after completion of fixing to a discharge port 13 for the sheet of paper 9 in the housing 10 and discharging the sheet of paper 9 to a discharge storage (not illustrated) is provided between the fixing device 5 and the discharge port 13. The discharge transport path Rt3 is formed by disposing a pair of transport rollers, discharge rollers (not illustrated), and multiple guiding members (not illustrated) that guide the transport of the sheet of paper 9.

In the fixing device 5, the sheet of paper 9 after completion of the second transfer by the second transfer device 35 is introduced to a fixing processor in the fixing device 5 through the relay transport path Rt2.

Thus, the sheet of paper 9 undergoes fixing processing by the fixing device 5, a toner image is fixed, and a full-color image is formed on one side of the sheet.

Finally, the sheet of paper 9 after completion of the fixing is discharged to a discharge storage (not illustrated) through the discharge transport path Rt3.

In the image forming apparatus 1, a sheet of paper 9 with a full-color image formed is outputted by the above operations. Incidentally, with the image forming apparatus 1, it is possible to form other type of images including a single color image such as a black image.

<Configuration of Developer Replenishing Device>

In the image forming apparatus 1, as illustrated in FIGS. 1 and 2, a desired amount of developer of a corresponding color is replenished through a developer replenishing device 7 to the developing devices 24 (Y, M, C, K) of the image forming devices 2 (Y, M, C, K) from developer containers 18Y, 18M, 18C, 18K which store developer by color.

The developer containers 18 (Y, M, C, K) are replaceable cartridge storage containers, which are used by being detachably mounted on a mounting device 17. When the developing device 24 uses two-component developer, each developer container 18 (Y, M, C, K) stores toner of one of four colors (Y, M, C, K) or toner including carrier slightly, as the developer.

The developer stored in each developer container 18 (Y, M, C, K) is replenished from the replenishing device 7 individually disposed under a mounting device 17 to the developing device 24 (Y, M, C, K). A symbol 78 in FIGS. 1 and 2 indicates a transport pipe which is installed to transport developer replenished from each replenishing device 7 to the developing device 24 (Y, M, C, K).

As illustrated by a dashed-two dotted line in FIG. 2, a driving device 192 for driving a unit to discharge the developer in the developer container 18 is disposed in each mounting device 17. In addition, as illustrated by a dashed line in FIG. 2, the mounting device 17 is provided with a discharge port 19*a* for discharging developer supplied from the developer container 18 and delivering the developer to (the later-described receiving port 71 of) the replenishing device 7.

Figure 3:
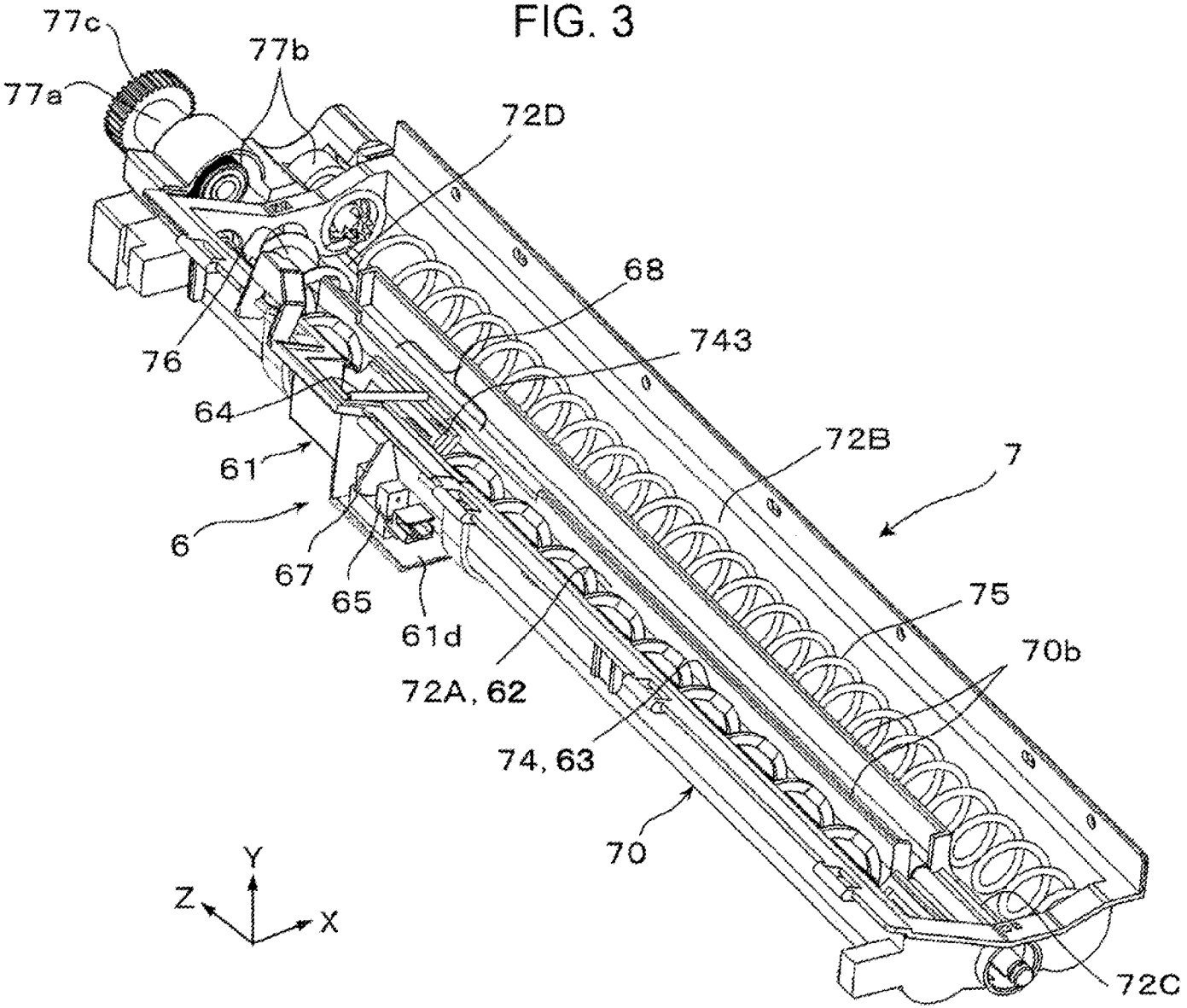
FIG. 3 is a perspective view illustrating a developer replenishing device (with the upper surface plate removed) and a storage height detection device.
Figure 4:
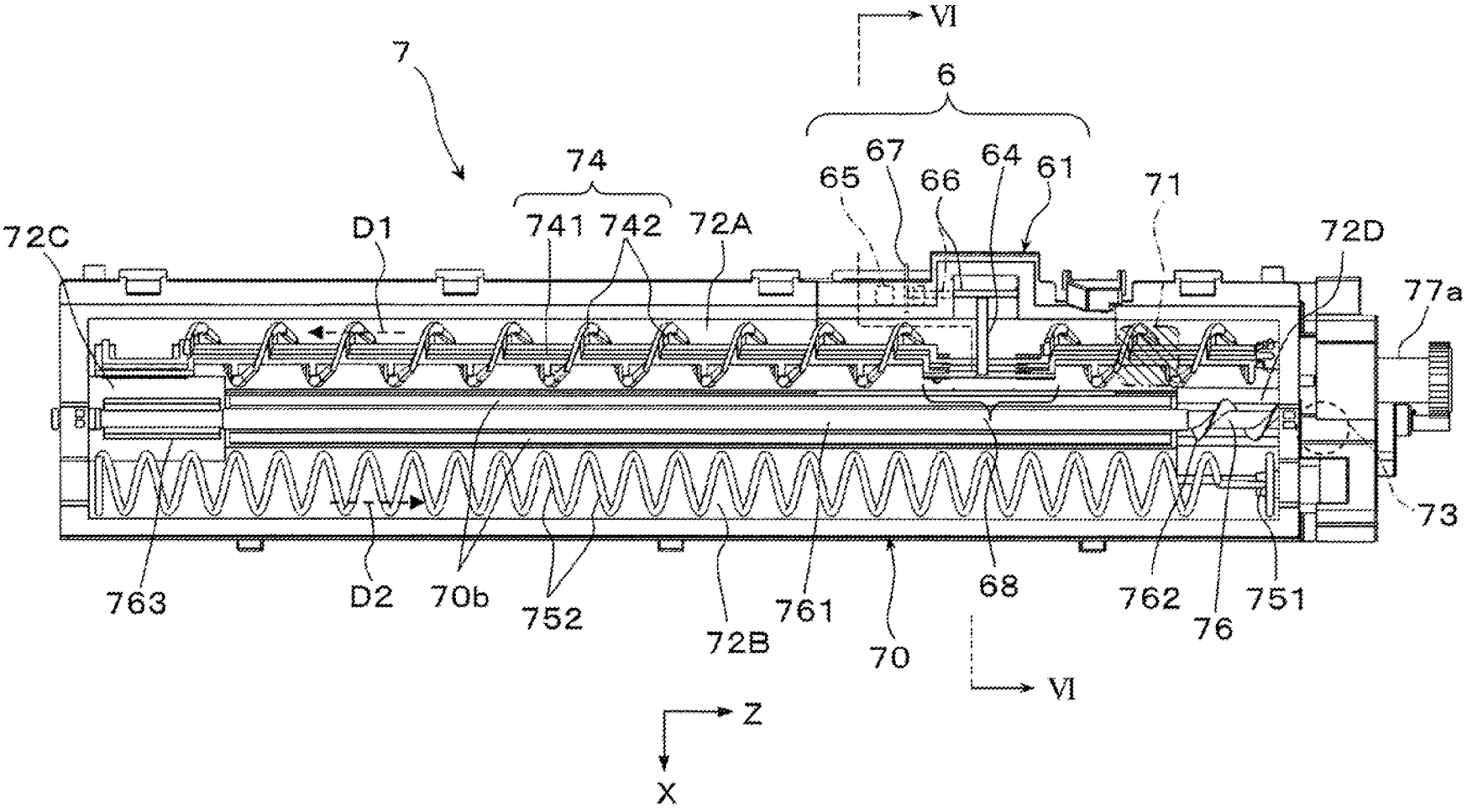
FIG. 4 is a plan view illustrating the replenishing device and the storage height detection device of FIG. 3.

As illustrated in FIGS. 2 to 4, the replenishing device 7 includes a main body 70 having a receiving port 71 for receiving developer supplied from a developer container 18 (Y, M, C, K), transport paths 72A, 72B for transporting developer, and a delivery port 73 for delivering the developer in the transport paths 72A, 72B to a replenishment destination such as the developing device 24; transport units 74, 75 for developer which are individually disposed so as to rotate in the transport paths 72A, 72B; a delivery unit 76 that delivers the developer in the transport paths 72A, 72B to the delivery port 73; and a developer storage height detection device 6 that detects the storage height of the surface of the developer transported in the transport path 72A.

The main body 70 is a container-like structure which is long in one direction (for instance, the depth direction, the longitudinal direction indicated by an arrow Z). Under the main body 70, two transport paths 72A, 72B are provided, which extend in parallel to the longitudinal direction. FIGS. 3, 4 and other figures illustrate the replenishing device 7 with an upper surface plate (lid body, not illustrated) of the main body 70 removed.

The transport path 72A is a first transport path 72A, and the transport path 72B is a second transport path 72B.

Figure 5:
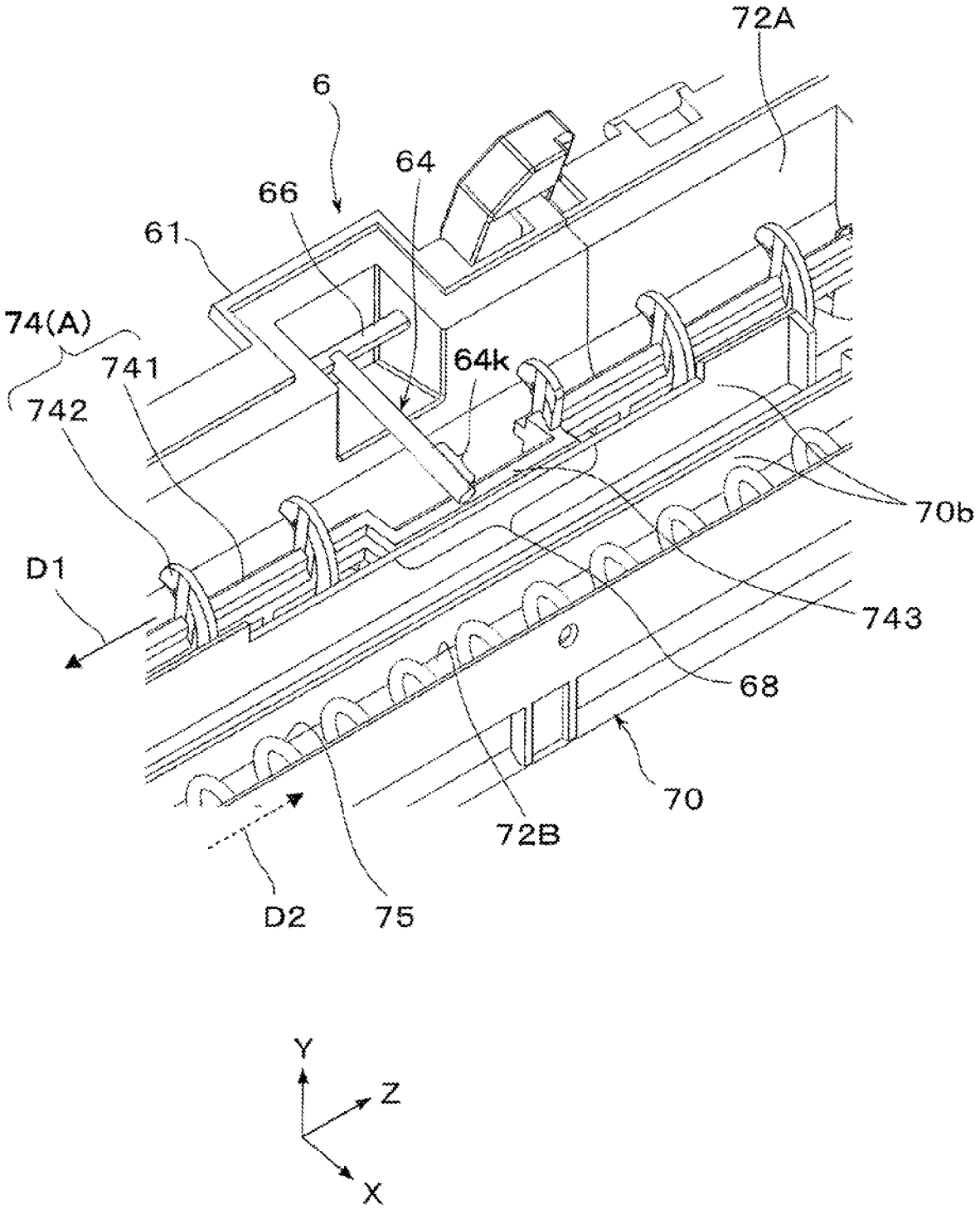
FIG. 5 is an enlarged perspective view illustrating part of the storage height detection device of FIG. 4.

As illustrated in FIGS. 4, 5 and other figures, each of the first transport path 72A and the second transport path 72B is formed as a linearly extending groove having a U-shaped cross section.

In addition, the first transport path 72A and the second transport path 72B are divided by a plate-like partition wall 70*b* extending therebetween in the longitudinal direction, and are connected to each other at longitudinal both ends via a first communication path 72C and a second communication path 72D where the partition wall 70*b* is not present. Thus, the first and second transport paths 72A and 72B are formed as a single continuous transport path.

As illustrated in FIGS. 2 and 4, the receiving port 71 is provided at a position above near the end of the first transport path 72A in the main body 70 on the upstream side of the transport direction (D1) of developer. The receiving port 71 is formed in the upper surface plate (not illustrated) of the main body 70. In addition, the receiving port 71 is opposed and connected to the discharge port 19*a* for developer in the mounting device 17 of the developer container 18 (FIG. 2).

As illustrated in FIGS. 2 and 4, the delivery port 73 is provided at a portion (one end of the main body 70 in the longitudinal direction) outwardly of the second communication path 72D.

The transport unit 74 for developer is a first transport unit disposed in the first transport path 72A. The transport unit 75 for developer is a second transport unit disposed in the second transport path 72B.

As illustrated in FIGS. 3 to 5, the first transport unit 74 includes a transport member in a structure having a transporter 742 which is spirally provided with a predetermined pitch with an interval around a rotational shaft 741. The first transport unit 74 is rotatably disposed in the first transport path 72A. The second transport unit 75 includes a transport member in a structure having a transporter 752 which is provided to spirally extend with a predetermined pitch from a rotational shaft 751 at one end to the other end without a shaft. The second transport unit 75 is rotatably disposed in the second transport path 72B.

The first transport unit 74 and the second transport unit 75 are rotated in a predetermined direction by rotational power transmitted from a drive input shaft 77*a* via a gear train mechanism 77*b*.

Consequently, in the first transport path 72A, developer is transported by the rotation of the first transport unit 74 in the direction indicated by an arrow D1. In the second transport path 72B, developer is transported by the rotation of the second transport unit 75 in the direction indicated by an arrow D2. Rotational power outputted from a driving device 712 (FIG. 2) for developer replenishment is transmitted to the drive input shaft 77*a* via an input gear 77*c*.

The delivery unit 76 is disposed to be in the second communication path 72D. The delivery unit 76 includes a rotational shaft 761 rotatably disposed in the main body 70 so as to pass the first communication path 72C and the second communication path 72D through the partition wall 70*b*; a spiral transporter 762 which is spirally provided as a projection continuously at the portion of the rotational shaft 761, from the second communication path 72D to the delivery port 73; and a plate-like delivery blade 763 which is provided in the shaft direction at a portion of the rotational shaft 761, the portion being present in the first communication path 72C.

Similarly to the case of the first transport unit 74 and the second transport unit 75 for developer, the delivery unit 76 is rotated in a predetermined direction by rotational power transmitted from the drive input shaft 77*a* via the gear train mechanism 77*b*.

Thus, in the delivery unit 76, the developer in the second communication path 72D is delivered by the spiral transporter 762 to the delivery port 73, and the developer in the first communication path 72C is delivered by the delivery blade 763 to the second transport path 72B.

The delivery unit 76 is configured to be rotated and driven simultaneously when the first transport unit 74 and the second transport unit 75 for developer are rotated and driven.

<Configuration of Developer Storage Height Detection Device>

Next, the developer storage height detection device 6 will be described.

First, as illustrated in FIGS. 3, 4 and other figures, part of the main body 70 is formed as a main body 61, the part being provided with the first the transport path 72A in the replenishing device 7 which is an example of an application object to which the storage height detection device 6 is applied. The storage height detection device 6 includes the first transport unit 74 for developer disposed in the first transport path 72A so as to rotate in the first transport path 72A; a swinging unit 64 that comes into contact with the surface of the developer transported in the first transport path 72A and swings by following at least the storage height of the developer surface; and a detection unit 65 that detects a state of swinging of the swinging unit 64.

The main body 61 is a portion of the main body 70 in the replenishing device 7, the portion being provided with at least the first transport path 72A. As illustrated in FIGS. 3 to 6, the main body 61 in the first exemplary embodiment has a structure in the main body 70, provided with a projection part having depressed space, the projection part projecting outwardly from part of the first transport path 72A in a direction substantially perpendicular to the transport direction D1 of developer. The depressed space in the projection part is used as the space for disposing part of the swinging unit 64.

As described above, the first transport unit 74 is disposed so as to rotate in the first transport path 72A, and includes a transport member in a structure having the transporter 742 which is provided spirally with an interval around the rotational shaft 7.

The swinging unit 64 is formed of a member in a cylindrical exterior shape. As illustrated in FIGS. 3 to 5, one end of the swinging unit 64 in the longitudinal direction is fixedly mounted on a swing support shaft 66 which is swingably disposed in the depressed space of the projection part in the main body 61. The other end of the swinging unit 64 in the longitudinal direction is provided to be in contact with the developer surface (S) which is the surface of the stored developer transported in the first transport path 72A. In addition, the swinging unit 64 is disposed to be in a state where the longitudinal direction is along a direction substantially perpendicular to the rotational shaft 741 of the first transport unit 74.

The swing support shaft 66 supporting the swinging unit 64 is rotatably provided in a direction substantially perpendicular to the rotational shaft 741 of the first transport unit 74, crossing the depressed space of the projection part of the main body 61. One end of the swing support shaft 66 is provided projecting outwardly from the lateral surface of the projection part of the main body 61.

As illustrated in FIGS. 3, 4, 6, and other figures, a detected plate 67 is fixedly mounted on an end portion of the projection part of the swing support shaft 66, the detected plate 67 being an example of a detected unit which is actually detected by the detection unit 65. The detected plate 67 is formed of a member in a sector shape, for instance. In addition, the detected plate 67 swings in coordination with the swinging unit 64 by receiving the swinging of the swinging unit 64 via the swing support shaft 66.

Figure 6A:
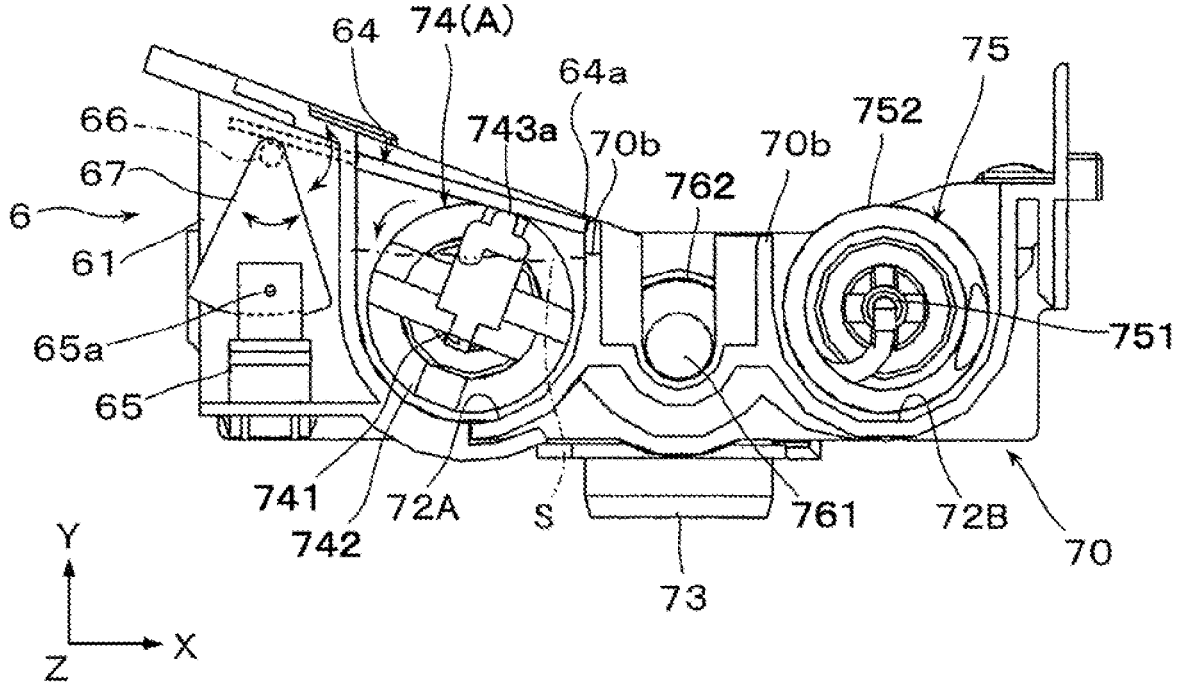
FIGS. 6A and 6B are schematic cross-sectional views taken along line VI-VI of the replenishing device and the storage height detection device of FIG. 4.
Figure 6B:
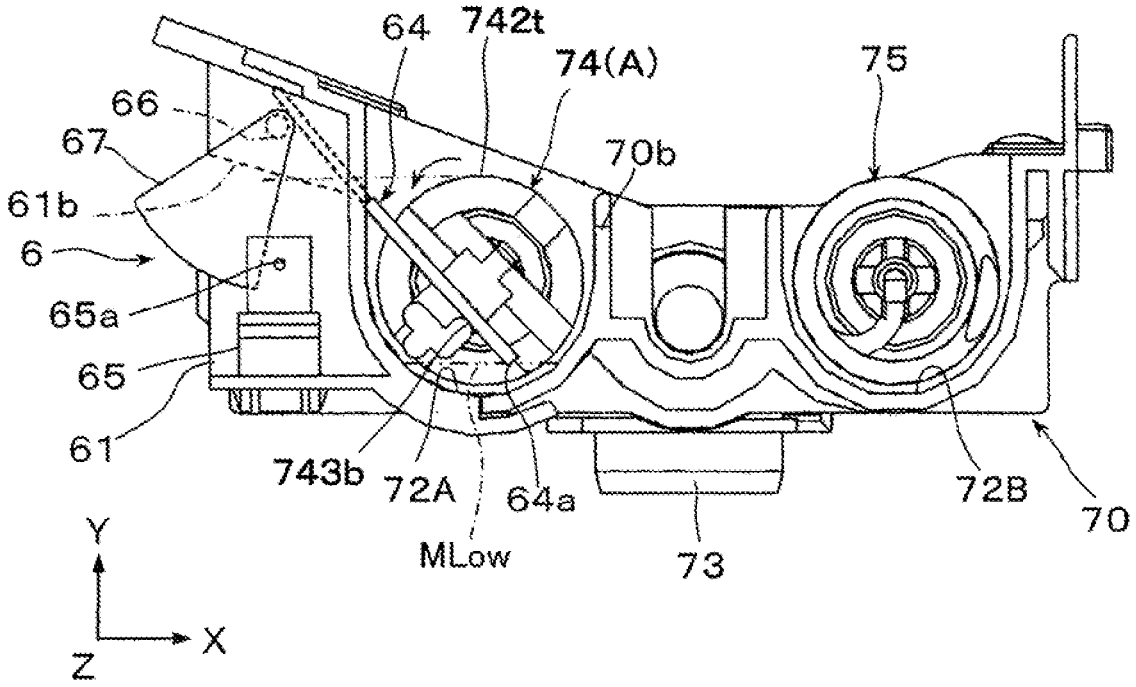
Figure 8:
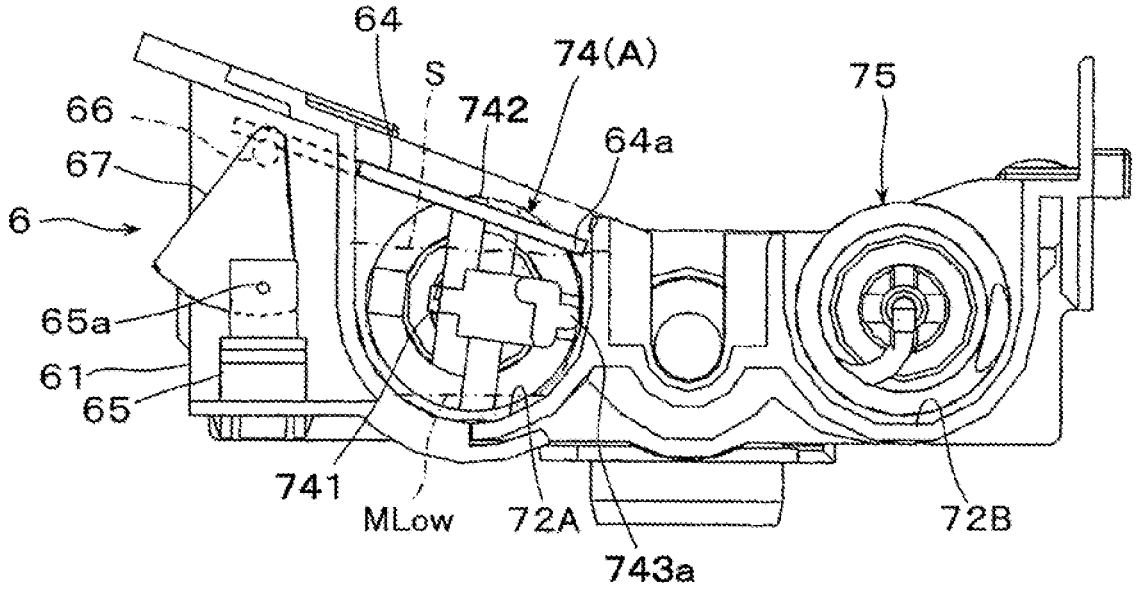
FIG. 8 is a schematic cross-sectional view illustrating another state of the replenishing device and the storage height detection device of FIG. 6.

As illustrated in FIG. 6A, the swinging unit 64 is fixedly mounted on the swing support shaft 66, thus is designed to swing around a pivot point of the swing support shaft 66 in the direction indicated by both arrows. Thus, as illustrated in FIGS. 6B and 8, in the swinging unit 64, a swing leading end which is the other end may come into contact with the surface (S) of the developer present in the first transport path 72A, and swings by following at least the storage height of the surface (S).

Here, the storage height is a distance of the surface (S) of the developer present in the first transport path 72A away from the bottom surface of the first transport path 72A, and is a substantially fixed value according to the amount (bulk) of developer stored and accumulated in the first transport path 72A.

The detection unit 65 detects a state of swinging of the swinging unit 64, and is a unit that detects a state of the detected plate 67 which swings in coordination with the swinging unit 64 in the first exemplary embodiment.

The detection unit 65 is formed by using a transmissive or reflexive photo sensor, for instance. The detection unit 65 including a photo sensor has a detector 65*a* that detects whether or not detection light emitted from a light emitter is received by a light receiver. A type of photo sensor including one detector 65*a* is applied to the detection unit 65 including a photo sensor in the first exemplary embodiment.

In contrast, when the detection unit 65 is a transmissive photo sensor, the detected plate 67 is formed as a member having a light shielding property. As illustrated in FIG. 6B, the detected plate 67 is configured to detect a state of swinging of the swinging unit 64 by the detection unit 65 in response to when the storage height of the surface (S) of the developer present in the first transport path 72A is reduced (when the storage height is close to a lowest detection height MLow).

As illustrated in FIG. 3 and other figures, the detection unit 65 is installed in a part 61*d* of the main body 61 (the main body 70 of the replenishing device 7) outwardly of the first transport path 72A.

The outward part 61*d*, in which the detection unit 65 in the first exemplary embodiment is installed, is formed as a part adjacent to one side of the projection part having the depressed space in which the base end of the swinging unit 64 is disposed. Thus, the part, in which the detection unit 65 is installed, is away from the first transport path 72A.

As illustrated in FIGS. 3 to 5, 10 and other figures, in the storage height detection device 6, the first transport unit 74(A) having a non-transport portion 68 where the transporter 742 is not present is applied as the first transport unit 74, and the swinging unit 64 is disposed to swing so as to be present in the non-transport portion 68 in the first transport unit 74(A). An upper portion 64*k* located above a contact portion 64*j* in contact with the developer in the first transport path 72A is configurated by an upward convex curved surface.

As illustrated in FIGS. 4 and 6, the first transport unit 74(A) has a structure in which the spiral transporter 742 is discontinued and not present in a portion corresponding to the area where the swinging unit 64 of the storage height detection device 6 is present. The portion (the portion where only the rotational shaft 741 is present, or the later-described eccentric shaft 743 is present in the example) where transporter 742 is discontinued and not present is formed as the non-transport portion 68.

In this case, as illustrated in FIGS. 4 and 6A, the swinging unit 64 is present at least on the upper side of (the rotational shaft 741, actually the later-described eccentric shaft 743 in) the non-transport portion 68, and is disposed so that a swing leading end 64*a* crosses over the later-described eccentric shaft 743 of the non-transport portion 68, and is present in the first transport path 72A, the swing leading end 64*a* being a free end on the opposite side to the base end supported by the swing support shaft 66.

In this case, in the portion where the non-transport portion 68 is present in the first transport path 72A, it is not possible for the developer to directly obtain a transport force by the transporter 742 of the first transport unit 74(A), thus the developer is in a stagnated state temporarily. However, the stagnated developer is pushed by the developer transported from the upstream side of the transport direction D1 of developer, thus is sequentially delivered to pass through the portion where the non-transport portion 68 is present.

Figure 7:
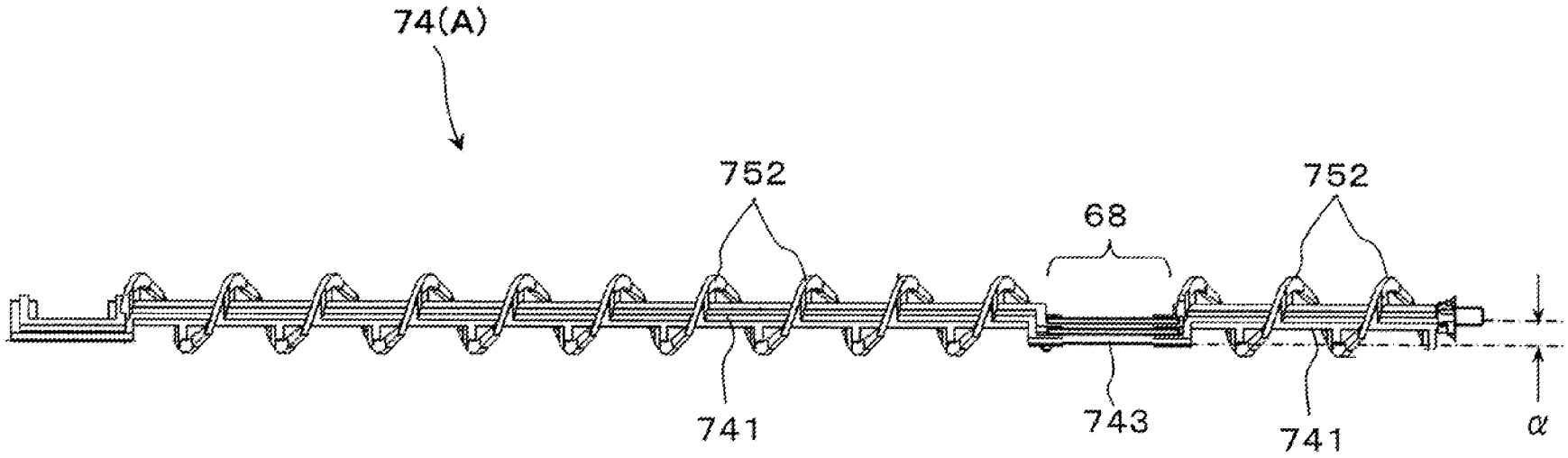
FIG. 7 is a plan view illustrating a transport unit for developer at a storage height detection position of FIG. 3.

As illustrated in FIG. 7 and other figures, an eccentric shaft 743 displaced from the axial center of the rotational shaft 741 in the portion other than the non-transport portion 68 is applied to the non-transport portion 68 in the first transport unit 74(A) as a rotational shaft.

As illustrated in FIG. 6B, the eccentric shaft 743 is formed as an eccentric shape with a predetermined eccentric amount $\alpha$ so that the swing leading end 64*a* can reach the lowest detection height (MLow) of the surface (S) of the developer with the swinging unit 64 in contact with the eccentric shaft 743.

As illustrated in FIG. 7 and other figures, the eccentric shaft 743 in the first exemplary embodiment is in a shape (crank shape) having a linear shaft portion parallel to the shaft direction of the rotational shaft 741 in the range of the non-transport portion 68 with a height of the eccentric amount $\alpha$ vertically displaced from the rotational shaft 741 at both ends of the non-transport portion 68.

In the storage height detection device 6, the eccentric shaft 743 is applied as the rotational shaft in the non-transport portion 68, thus for instance, when developer is not present in the first transport path 72A or when the developer is reduced, as illustrated in FIG. 6, the lower surface of the swinging unit 64 may periodically come into contact with the later-described outermost circumferential portion 743*a* or innermost circumferential portion 743*b* of the eccentric shaft 743 of the non-transport portion 68 in the first transport unit 74(A), and may assume a state of swinging.

Thus, as described above, the swinging unit 64 of the storage height detection device 6 swings by following the storage height of the surface (S) of the developer, and in addition, the swinging unit 64 may periodically swing vertically due to contact with the eccentric shaft 743 which rotates.

It is to be noted that the outermost circumferential portion 743*a* is the portion located at the outermost side of the eccentric shaft 743 with respect to the axial center of the rotational shaft 741. The innermost circumferential portion 743*b* is the portion located at the innermost side of the eccentric shaft 743 with respect to the axial center of the rotational shaft 741.

As illustrated in FIGS. 5, 10 and other figures, the swinging unit 64 is formed of a member in a cylindrical exterior shape, and it is sufficient that at least the upper portion 64*k* located above the contact portion 64*j* in contact with the surface (S) of the developer in the first transport path 72A be configurated by an upward convex curved surface.

Figure 10A:
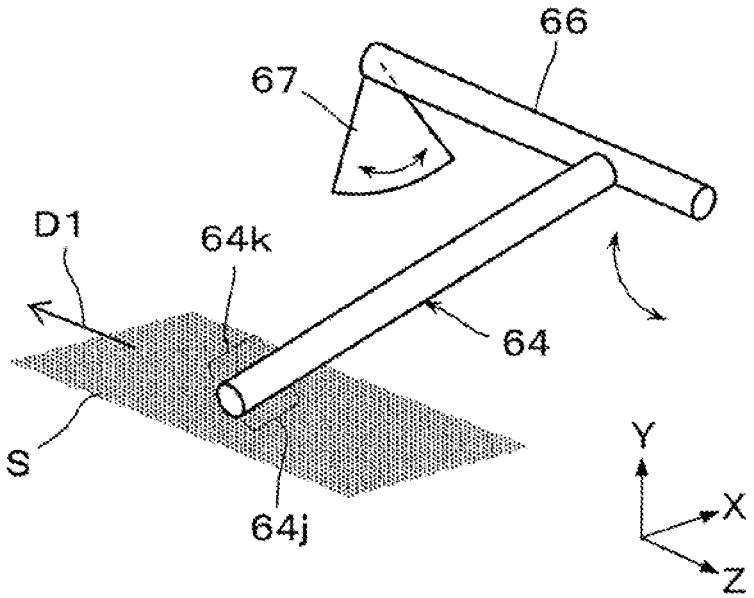
FIG. 10A is a schematic perspective view illustrating the configuration of the swinging unit at the storage height detection position of FIG. 3.
Figure 10B:
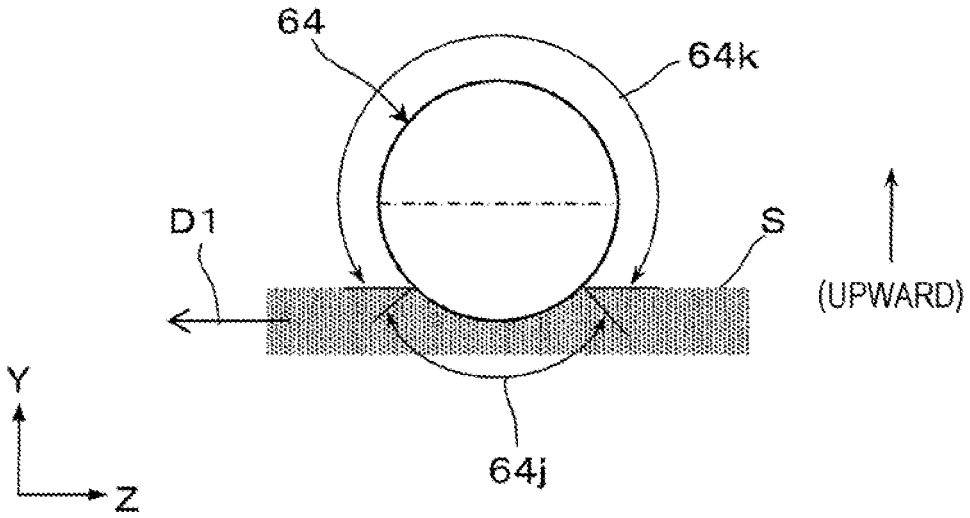
FIG. 10B is an enlarged schematic view illustrating a contact portion of the swinging unit of FIG. 10A.

As illustrated in FIG. 10B, the upper portion 64*k* indicates a portion present upward relative to the contact portion 64*j* by words. It can be stated that the upper portion 64*k* is a portion where developer may be accumulated at least, thus the upper portion 64*k* may include not only the portion immediately above the contact portion 64*j*, but also portions present in the surroundings of the contact portion 64*j*.

It is sufficient that the upward convex curved surface be a curved surface on which developer is unlikely to be accumulated. Typical examples include the lateral surface of a cylinder or a prism, and the surface of a sphere. The upward convex curved surface is not limited to an upper portion present immediately above the contact portion 64*j* of the swinging unit 64, and an upper portion present in the surroundings of the contact portion 64*j* may be similarly applied.

In addition, as illustrated in FIGS. 10A, 10B and other figures, in the swinging unit 64, the contact portion 64*j* is configurated by a downward convex curved surface.

It is sufficient that the downward convex curved surface be a curved surface in a shape which causes less friction when the curved surface comes into contact with the surface (S) of the developer transported and moved in the first transport path 72A. Typical examples include the lateral surface of a cylinder or a prism, the surface of a sphere, and a trapezoidal curved including a plane in part. It is desirable that the downward convex curved surface be a curved surface similar to and vertically symmetric with the curved surface of the upper portion 64*k*. However, the downward convex curved surface may be different from the curved surface of the upper portion 64*k*.

The swinging unit 64 in the first exemplary embodiment is formed of a member in a cylindrical exterior shape as a whole. Thus, the upward convex curved surface of the upper portion 64*k* is formed of a curved surface which is the lateral surface of a cylinder, and the downward convex curved surface of the contact portion 64*j* is formed of a curved surface which is the lateral surface of a cylinder. The curved surface of the contact portion 64*j* is vertically symmetric with the curved surface of the upper portion 64*k*.

More specifically, the swinging unit 64 in the first exemplary embodiment is formed of a member in a cylindrical exterior shape as a whole. In other words, the swinging unit 64 is formed to have a hollow structure. It is to be noted that not only the swinging unit 64 may have a hollow structure as a whole, but a portion (for instance, a leading side portion including the swing leading end 64*a*) including at least the contact portion 64*j* may be formed to have a hollow structure. Due to the use of a hollow structure, the swinging unit 64 can be reduced in weight, and can follow the surface (S) of the developer more accurately, as compared with when a hollow structure is not used.

As illustrated in FIG. 6B, in the storage height detection device 6, the swing support shaft 66 which serves as the pivot point for swinging is disposed at a position above an uppermost point 742*t* of the transporter 742, the uppermost point 742*t* being the uppermost point of the first transport unit 74(A).

In addition, as illustrated in FIG. 4 and other figures, the storage height detection device 6 is disposed at a position on the downstream side of the receiving port 71 in the transport direction D1 of developer, the position being close to the receiving port 71.

More specifically, the storage height detection device 6 is disposed so that the swinging unit 64 is present at a position (a position on the downstream side of the receiving port 71 in the transport direction D1 of developer) displaced from the position immediately below the receiving port 71 of the first transport path 72A.

<Operation of Developer Replenishing Device>

Next, the operation of the developer replenishing device 7 will be described. As illustrated in FIG. 2, the replenishing device 7 is operated by the control of a control unit 15.

Specifically, in the image forming apparatus 1, as illustrated in FIG. 2, the amount of developer (for instance, in the case of two-component developer, the amount, concentration of toner) stored in each developing device 24 (Y, M, C, K) is detected by a detection unit 28, and detected information is sent to the control unit 15 and managed. When the control unit 15 determines that one of the developing devices 24 (Y, M, C, K) is in a toner shortage state, control is performed to drive a driving device 712 for replenishment for a desired time, the driving device 712 causing the delivery unit 76 of a replenishing device 7 to rotate, the replenishing device 7 being connected to a developing device 24 of a color which is determined to be in a toner shortage state. In this manner, the replenishing device 7 is operated.

In this process, in the replenishing device 7, the rotational power of the driving device 712 for replenishment is transmitted to the first transport unit 74(A) and the second transport unit 75, which are driven to rotate in a predetermined direction.

Thus, the developer stored in the first transport path 72A and the second transport path 72B is transported in predetermined directions D1, D2 (FIG. 4) by the transport force of the first transport unit 74(A) and the transport force of the second transport unit 74(B).

Specifically, the developer in the replenishing device 7 is transported back and forth between the first transport path 72A and the second transport path 72B through the first communication path 72C and the second communication path 72D, and is transported in circulation as a whole. When part of the developer is transported and moved in the second communication path 72D, the part of the developer receives the transport force of the transporter 762 of the delivery unit 76, and is delivered to the delivery port 73.

In this manner, in the replenishing device 7, the developer stored in the first transport path 72A and the second transport path 72B of the main body 70 is delivered from the delivery port 73 through the second communication path 72D, and the delivered developer is sent to a developing device 24 of a color which is determined to be in a toner shortage state via the transport pipe 78, thereby achieving replenishment of the developer.

As illustrated in FIG. 2, in the replenishing device 7, the storage height of the surface (S) of the developer in the first transport path 72A in the main body 70 is detected by the developer storage height detection device 6. A detection result is sent to the control unit 15, and is managed.

When the storage height of the developer in the first transport path 72A is reduced, and it is determined that the developer stored in the main body 70 is in a shortage state, control is performed to drive the driving device 192 of a mounting device 17 for a desired time, the mounting device 17 being connected to a replenishing device 7 which is determined to be in shortage.

Thus, a unit for discharging the developer in the developer container 18 of the mounting device 17 is operated, and the developer in the developer container 18 is supplied and replenished to the replenishing device 7 through the mounting device 17. In this process, the developer in the developer container 18 is discharged through the discharge port 19*a* in the mounting device 17, then is dropped and supplied to the first transport path 72A through the receiving port 71 of the replenishing device 7.

<Operation of Developer Storage Height Detection Device>

Next, the operation of the developer storage height detection device 6 will be described. When the replenishing device 7 is operated, the storage height detection device 6 detects the storage height of the developer present in the first transport path 72A of the main body 70.

In the storage height detection device 6, the swinging unit 64 swings by following at least the storage height of the surface (S) of the developer stored in the portion (hereinafter simply referred to as the "detection area"), where the non-transport portion 68 is present, of the first transport unit 74(A) in the first transport path 72A, and the detection unit 65 detects a state of swinging of the swinging unit 64.

In the storage height detection device 6, in the detection area, the eccentric shaft 743 of the non-transport portion 68 in the first transport unit 74(A) rotates around the rotational shaft 741 as the center, thus the eccentric shaft 743 moves to pass through under the swinging unit 64.

Here, when a stage is assumed where a sufficient amount of developer is stored in the detection area in the first transport path 72A, the swinging unit 64 operates in the following manner to detect the storage height of the developer in the stage.

Specifically, in the stage where a sufficient amount of developer is stored, as illustrated in FIG. 6A, the swinging unit 64 comes into contact with the outermost circumferential portion 743*a* of the eccentric shaft 743 of the non-transport portion 68 rotating in the detection area in the first transport unit 74(A), and may assume a state of swinging in the direction in which the swing leading end 64*a* is raised (lifted), or as illustrated in FIG. 8, the swing leading end 64*a* does not come into contact with the eccentric shaft 743 regardless of the position of the eccentric shaft 743 of the non-transport portion 68 in the first transport unit 74(A) in rotation, and may assume a state of swinging to a position to come into contact with the surface (S) of the developer.

Figure 9:
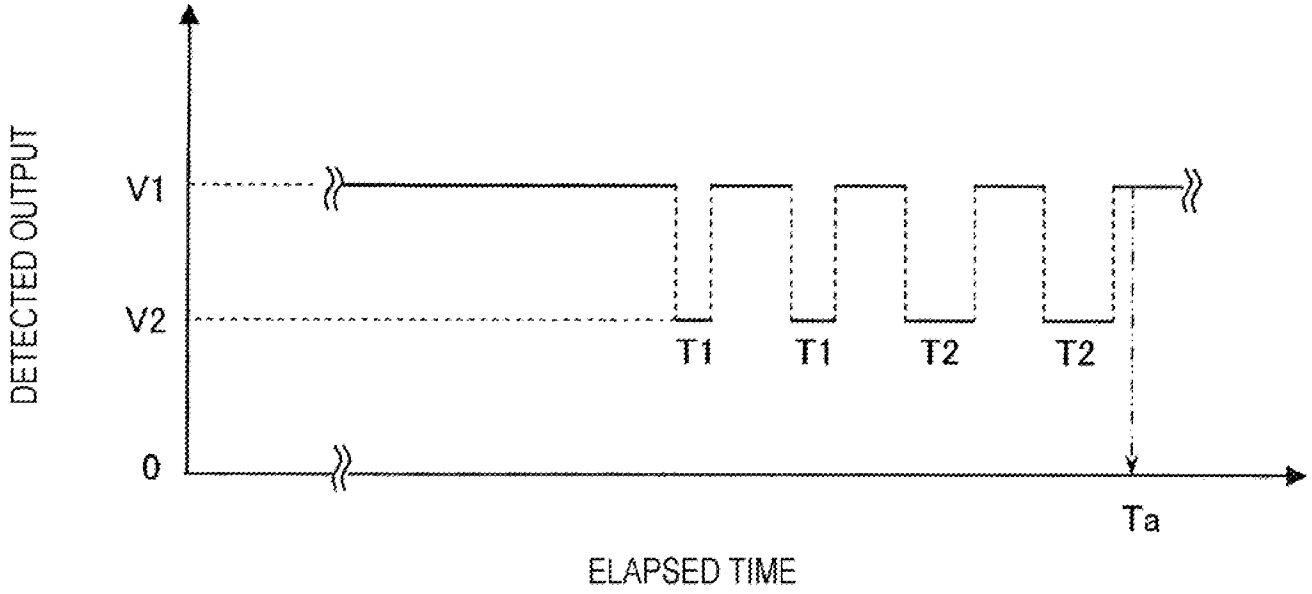
FIG. 9 is a conceptual graph illustrating an example of a detection output of a detection unit in the first exemplary embodiment.

In this process, even when the detected plate 67, which swings in coordination with the swinging unit 64, assumes any one of the above-mentioned states of swinging, as illustrated in FIGS. 6A and 8, the detected plate 67 assumes a state of swinging to a position to block the detection light of the detector 65*a* of the detection unit 65. As illustrated in FIG. 9, the detection output of the detection unit 65 at this point is obtained as a predetermined first output value (V1).

In the storage height detection device 6 (or the control unit 15), it is set that the detection output of the detection unit 65 at this point is regarded as detection information indicating that "developer is present".

In contrast, when a stage is assumed where the developer stored in the detection area of the first transport path 72A is gradually reduced due to a replenishment operation, the swinging unit 64 assumes the state as described below in the stage, and the storage height of the developer is detected.

Specifically, in the stage where the developer is reduced, the storage height of the surface (S) of the developer starts to decrease relatively, thus the swinging unit 64 with the swing leading end 64*a* in contact with the surface (S) assumes a state of starting to swing in the direction in which the swing leading end 64*a* is lowered.

In this process, when the storage height of the developer is reduced to a height closer to the lowest detection height MLow, as illustrated in FIG. 6B, the detected plate 67 which swings in coordination with the swinging unit 64 sometimes assumes a state of swinging to a position not to block the detection light of the detector 65*a* of the detection unit 65. As illustrated in FIG. 9, the detection output of the detection unit 65 at this point is obtained as a predetermined second output value (V2).

The second output value (V2) is a value different from the first output value (V1). The second output value (V2) is obtained as an output value for a relatively short time T1 before the swinging unit 64 illustrated in FIG. 6B comes into contact with the innermost circumferential portion 743*b* of the eccentric shaft 743 of the non-transport portion 68, and is caused to swing. However, the second output value (V2) is obtained as a substantially constant output value for a relatively long time T2 (>T1) after the swinging unit 64 comes into contact with the innermost circumferential portion 743*b* of the eccentric shaft 743 of the non-transport portion 68, and is caused to swing.

In this process, the swinging unit 64 comes into contact with the outermost circumferential portion 743*a* of the eccentric shaft 743 of the non-transport portion 68 rotating in the detection area in the first transport unit 74(A), and assumes a state of swinging in the direction in which the swing leading end 64*a* is raised. The state of swinging in this manner continues while the first transport unit 74(A) is in rotation.

As illustrated in FIG. 6A, the detected plate 67 then assumes a state of swinging to a position to block the detection light of the detector 65*a* of the detection unit 65. As illustrated in FIG. 9, the detection output of the detection unit 65 at this point is obtained as the first output value (V1) again.

In the storage height detection device 6 (or the control unit 15), it is set that for instance when the second output value (V2) during the time T2 among the detection outputs of the detection unit 65 is obtained multiple times exceeding a predetermined number of times at a time point (Ta) as illustrated in FIG. 9, this output is regarded as detection information indicating that "developer is in shortage or not present".

In addition, as illustrated in FIGS. 3 to 6, 8, 10 and other figures, in the storage height detection device 6, the swinging unit 64 is formed of a member in a cylindrical exterior shape, and the upper portion 64*k* located above the contact portion 64*j* in contact with the surface (S) of the developer is configurated by an upward convex curved surface. Thus, as compared with when the upper portion 64*k* is not configurated by an upward convex curved surface (for instance, a horizontal plane, a smooth inclined surface, or a downward convex curved surface), even when developer is placed on the upper portion 64*k*, the developer is unlikely to remain thereon. Thus, in the swinging unit 64, there is no possibility of accumulation of the developer at least on the upper portion 64*k*.

In addition, in the storage height detection device 6, the contact portion 64*j* of the swinging unit 64 is configurated by a downward convex curved surface. Thus, as compared with when the contact portion 64*j* is not configurated by a downward convex curved surface (for instance, a plane or an upward convex curved surface), the swinging unit 64 is likely to receive an upward force from the surface (S) of the developer moved in the transport direction D1 by transport in the first transport path 72A, and is unlikely to be buried. Also, the swinging unit 64 is likely to come into contact with the surface of the developer with less friction. Consequently, the swinging unit 64 swings while following the surface (S) of the developer accurately.

Therefore, the storage height detection device 6 detects the storage height of the developer in the first transport path 72A in the main body 70 of the developer replenishing device 7 without causing reduction in the accuracy of detection due to accumulation of developer. In addition, detection can be performed while the surface (S) of the developer is accurately followed by at least the contact portion 64*j* of the swinging unit 64, which does not cause reduction in the accuracy of detection.

Incidentally, with the storage height detection device 6, the storage height of the developer in the first transport path 72A is detected without providing space for saving and detecting developer separately from the developer in the first transport path 72A or expanding the first transport path 72A for installing the swinging unit 64, for instance.

In addition, in the storage height detection device 6, the eccentric shaft 743 is applied to the non-transport portion 68 in the first transport unit 74(A), thus as compared with when the eccentric shaft 743 is not applied, the width (swing width) in the direction (particularly, the downward direction) of swinging in the first transport path 72A of the swinging unit 64 is likely to be increased. In addition, appropriate setting of the eccentric amount $\alpha$ of the eccentric shaft 743 allows reliable detection of the storage height (particularly, a state where the storage height is closer to the lowest detection height MLow) of the developer in less volume, particularly.

Additionally, in the storage height detection device 6, the swing support shaft 66, which serves as a pivot point of the swinging unit 64 at the time of swinging, is disposed at a position above the uppermost point 742*t* of the first transport unit 74(A), thus as compared with when the swing support shaft 66 is not disposed at such a position, the swing leading end 64*a* of the swinging unit 64 easily detects the storage height of the developer in less volume in the first transport path 72A. In addition, the detection unit 65 is disposed at the part 61*d* outwardly of the first transport path 72A, thus as compared with when the detection unit 65 is not disposed at such outward part 61*d*, there is no possibility of contamination of the detection unit 65 with developer, and stable detection is possible.

In the storage height detection device 6, particularly the swinging unit 64 is disposed at a position on the downstream side of the receiving port 71 on the first transport path 72A in the replenishing device 7 in the transport direction D1 of developer, the position being close to the receiving port 71 (FIG. 4). Thus, as compared with when the swinging unit 64 is not disposed at such a position (for instance, the swinging unit 64 is disposed at a position at an end of the first transport path 72A on the downstream side of the receiving port 71, or any position on the second transport path 72B), the swinging unit 64 is close to the receiving port 71 which reflects the amount of developer supplied from the developer container 18, thus the storage height of the developer in less volume is effectively detected earlier. In addition, the swinging unit 64 is disposed at a position displaced from the position immediately below the receiving port 71, thus the developer received through the receiving port 71 in the replenishing device 7 is easily placed and accumulated on the swinging unit 64, and unstable swinging of the swinging unit 64 is avoided, and reduction in the accuracy of detection is also avoided.

Second Exemplary Embodiment

Figure 11A:
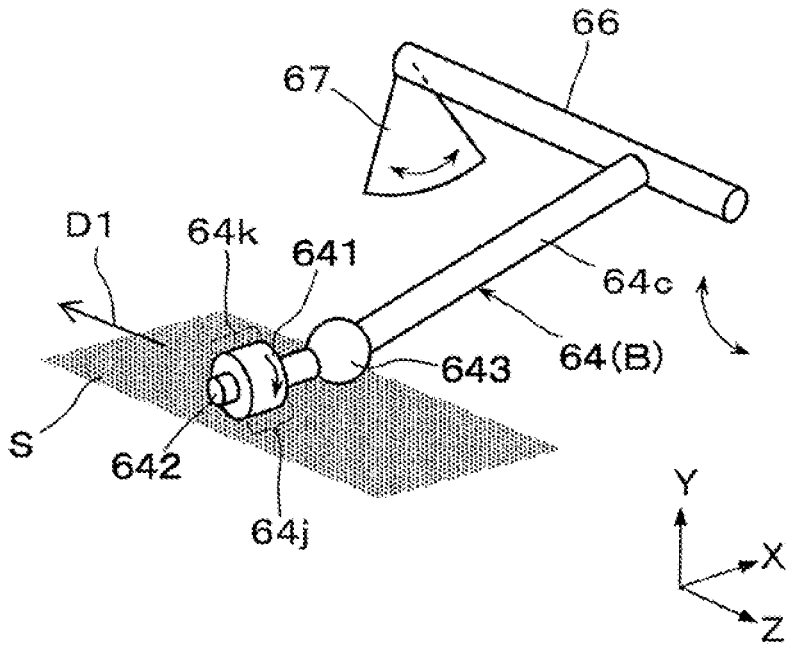
FIGS. 11A and 11B are views illustrating part of a storage height detection device according to a second exemplary embodiment.
Figure 11B:
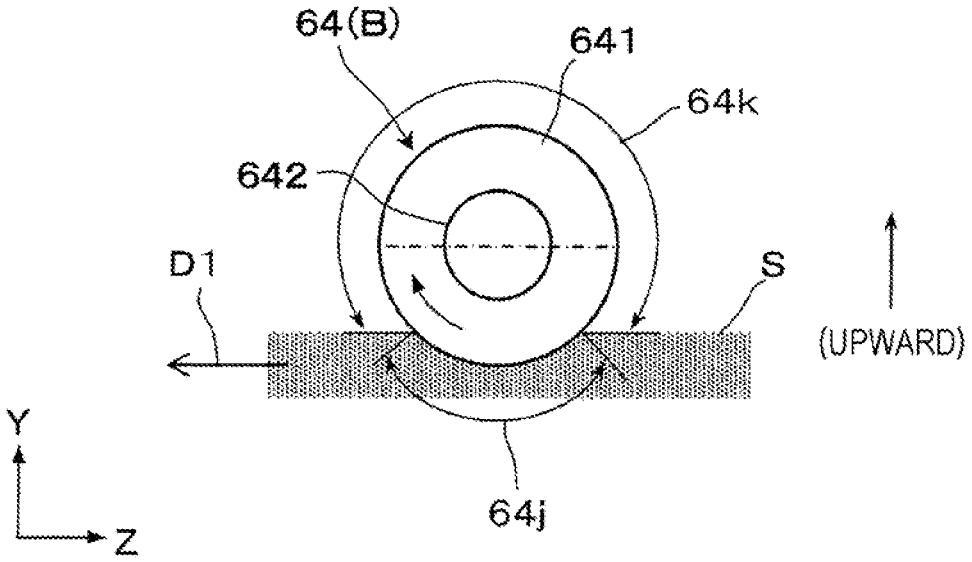

FIGS. 11A and 11B are views illustrating part of a developer replenishing device 7 including a developer storage height detection device 6 according to a second exemplary embodiment of the present disclosure.

The developer storage height detection device 6 and the replenishing device 7 according to the second exemplary embodiment have the same configuration as that of the developer storage height detection device 6 and the replenishing device 7 according to the first exemplary embodiment except that the swinging unit 64 in the storage height detection device 6 is changed to a swinging unit 64(B).

As illustrated in FIGS. 11A and 11B, the swinging unit 64(B) in the storage height detection device 6 according to the second exemplary embodiment is rotatably formed so that a portion including the contact portion 64*j* follows the movement (movement of travelling in substantially the transport direction D1) of the surface (S) of the developer transported in the first transport path 72A.

Specifically, the swinging unit 64(B) is such that one end of a support part 64*c* is fixedly mounted on the swing support shaft 66, and a rotational part 641 is rotatably provided in the other end.

The rotational part 641 is formed of a member, for instance, in a cylindrical or tubular exterior shape, and is rotatably mounted on a rotational support shaft 642 extending from the other end of the support part 64*c* in a direction substantially perpendicular to the rotational shaft 741 in the first transport unit 74(A) and substantially parallel to the surface (S) of the developer. The rotational support shaft 642 is mounted on the other end of the support part 64*c* with a connection portion 643 composed of a ball joint interposed therebetween.

As illustrated in FIG. 11B, the rotational part 641 includes a contact portion 64*j* and an upper portion 64*k* located above the contact portion 64*j*, and is formed of a cylindrical or tubular member, for instance. Thus, the rotational part 641 is rotatably mounted on the rotational support shaft 642 in structure, and a cross section perpendicular to the rotational support shaft 642 has a circular shape.

In the storage height detection device 6 according to the second exemplary embodiment, at the time of operation, as illustrated in FIG. 11A, the rotational part 641 of the swinging unit 64(B) follows the movement of the surface (S) of the developer present in the detection area of the first transport path 72A to rotate in the direction indicated by an arrow, and follows the storage height of the surface (S) of the developer. Thus, the swinging unit 64(B) operates to swing according to the state of the rotational part 641.

In the swinging unit 64(B), the upper portion 64*k* present above the contact portion 64*j* in contact with the surface (S) of the developer in the rotational part 641 is configurated by an upward convex curved surface, and the rotational part 641 rotates by following the movement of the surface (S) of the developer. Thus, as compared with when the upper portion 64*k* is not configurated by an upward convex curved surface, and a portion including the contact portion 64*j* is not rotatably formed, even when developer is placed on the upper portion 64*k*, the developer is further unlikely to remain thereon. Even if developer remains, the developer is caused to fall down due to rotation, and is easily removed. Therefore, in the swinging unit 64(B), there is no possibility of accumulation of developer at least on the upper portion 64*k* (the upper surface of the rotational part 641)

Incidentally, in the swinging unit 64(B), when the rotational support shaft 642 and the connection portion 643, which are arranged close to the surface (S) of the developer, are formed of an elongated cylindrical shape and a spherical shape as in the second exemplary embodiment, there is no possibility of accumulation of developer on the upper surfaces of the rotational support shaft 642 and the connection portion 643.

Furthermore, in the storage height detection device 6, the rotational part 641 including the contact portion 64*j* of the swinging unit 64(B) is configurated by a downward convex curved surface, and also rotates. Thus, as compared with when the contact portion 64*j* is not configurated by a downward convex curved surface, and not rotatably formed, the swinging unit 64 easily comes into contact with the surface (S) of developer with further less friction, and is unlikely to be buried, the developer being moved in the transport direction D1 by transport in the first transport path 72A. Consequently, the swinging unit 64(B) does not interfere with the transport flow of the developer in the first transport path 72A, and swings while following the surface (S) of the developer more accurately.

Therefore, with the storage height detection device 6, the storage height of the developer in the first transport path 72A in the main body 70 of the developer replenishing device 7 is detected without causing reduction in the accuracy of detection due to accumulation of developer.

Furthermore, in the swinging unit 64(B) in the storage height detection device 6, the rotational part 641 including the contact portion 64*j* does not interfere with the transport flow of the developer in the first transport path 72A, and detection is performed with the surface (S) of the developer more accurately followed while the developer once accumulated on the upper portion 64*k* is removed by rotation, and this causes no reduction in the accuracy of detection.

<Modification of Second Exemplary Embodiment>

Figure 12A:
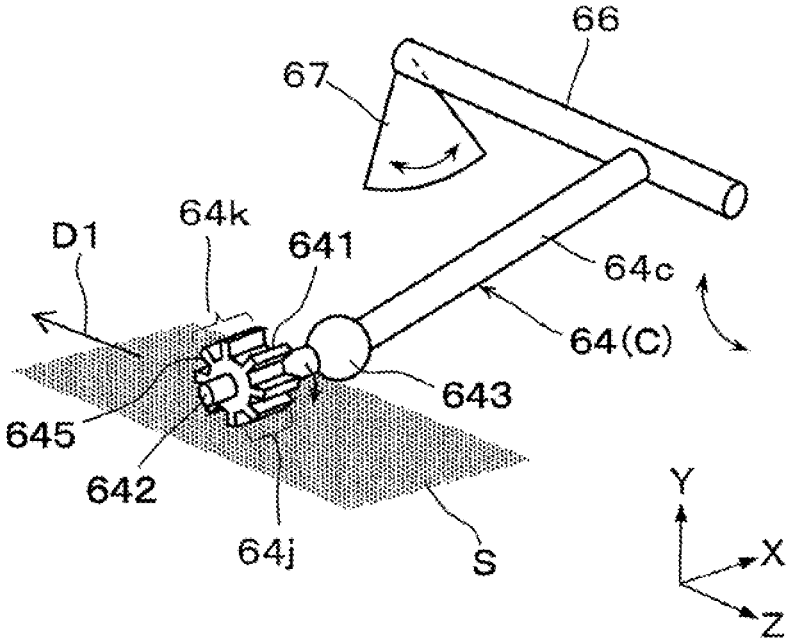
FIGS. 12A and 12B are views illustrating part of a modification of the storage height detection device according to the second exemplary embodiment.
Figure 12B:
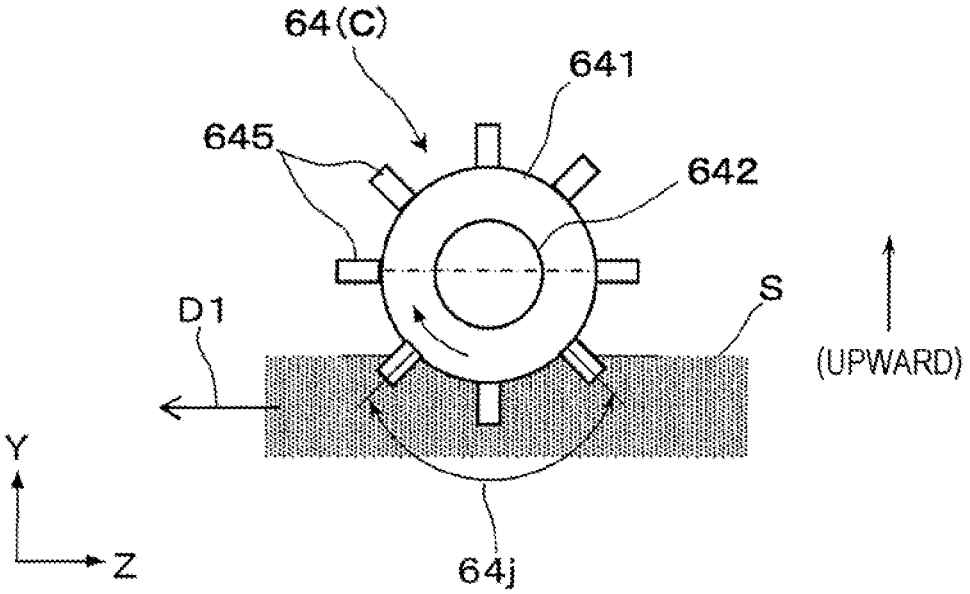

As illustrated in FIGS. 12A and 12B, the swinging unit 64(B) in the storage height detection device 6 may be changed to a swinging unit 64(C) in which the rotational part 641 including the contact portion 64*j* is formed in a shape having projections 645 which follow the transport flow of the developer and promote rotation.

The projections 645 in the swinging unit 64(C) are plate-like structural parts which extend substantially parallel to the rotational support shaft 642 and are provided radially projecting from multiple positions on the outer circumferential surface of the rotational part 641. In the swinging unit 64 (C) illustrated in FIGS. 12A and 12B, eight plate-like projections 645 are disposed with equal intervals. However, the number and shape of projections 645 are not particularly limited as long as there is no possibility of interference with the transport flow of the developer and excessive swinging due to the projections 645 of the swinging unit 64(C).

In the storage height detection device 6 to which the swinging unit 64(B) is applied, as compared with when the rotational part 641 including the contact portion of the swinging unit 64 is formed in a shape having the projections 645 which follow the transport flow of the developer and promote rotation, the rotational part 641 receives the movement of the transported developer by the projections 645, and rotation is promoted so as to be assisted.

Consequently, the storage height detection device 6 provides the same effect as that of the storage height detection device 6 according to the second exemplary embodiment. In particular, detection can be performed while the swinging unit 64(C) follows the surface (S) of the developer more accurately without interfering with the transport flow of the developer in the first transport path 72A.

Third Exemplary Embodiment

Figure 13A:
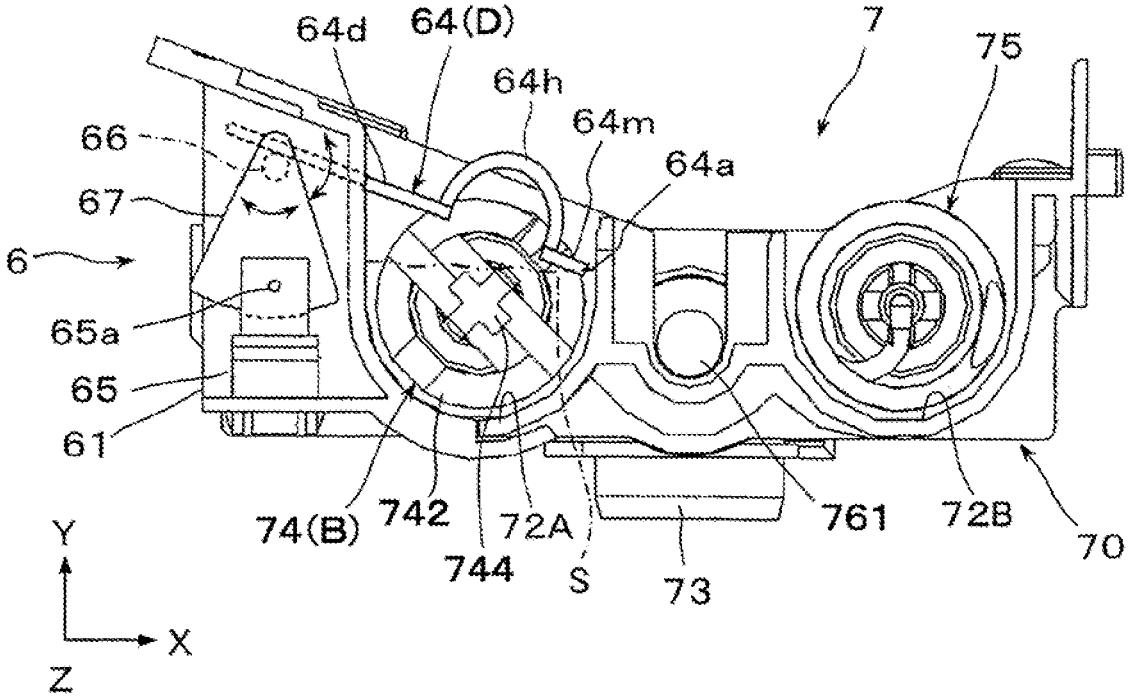
FIGS. 13A and 13B are schematic cross-sectional views illustrating a replenishing device and a storage height detection device according to a third exemplary embodiment.
Figure 13B:
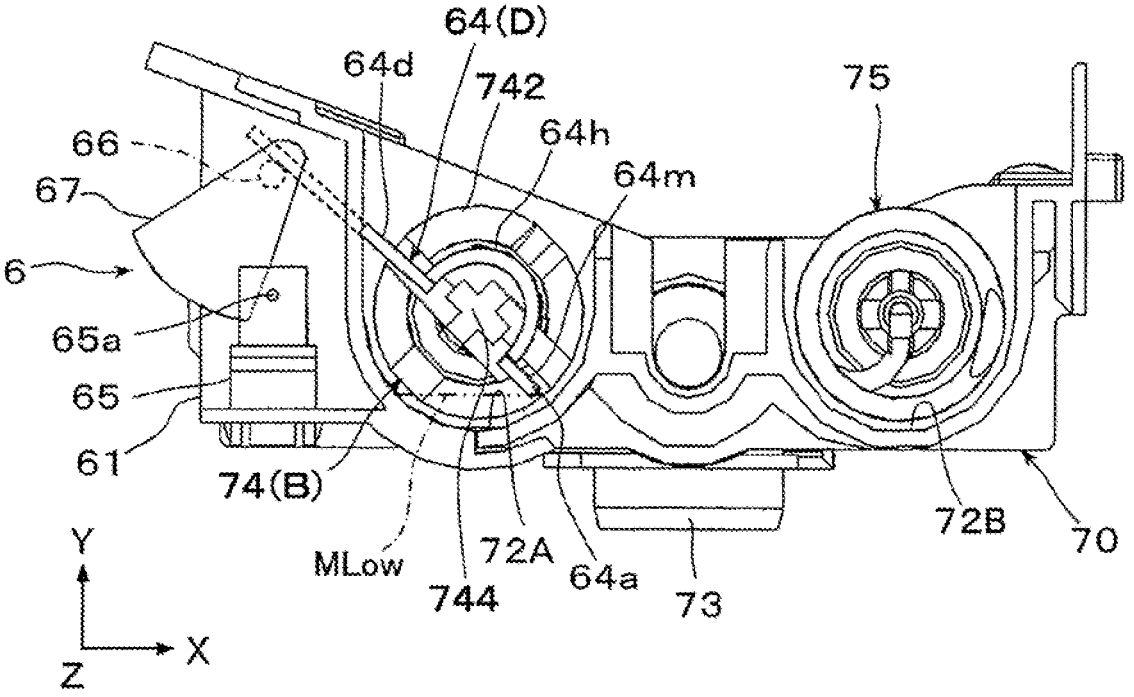

FIGS. 13A and 13B are views illustrating a developer replenishing device 7 including a developer storage height detection device 6 according to a third exemplary embodiment of the present disclosure.

The developer storage height detection device 6 and the replenishing device 7 according to the third exemplary embodiment has the same configuration as that of the developer storage height detection device 6 and the replenishing device 7 according to the first exemplary embodiment except that the first transport unit 74(A) related to the storage height detection device 6 is changed to a first transport unit 74(B) having a partially different configuration, and the swinging unit 64 is changed to a swinging unit 64(D) having a partially different configuration.

Figure 14:
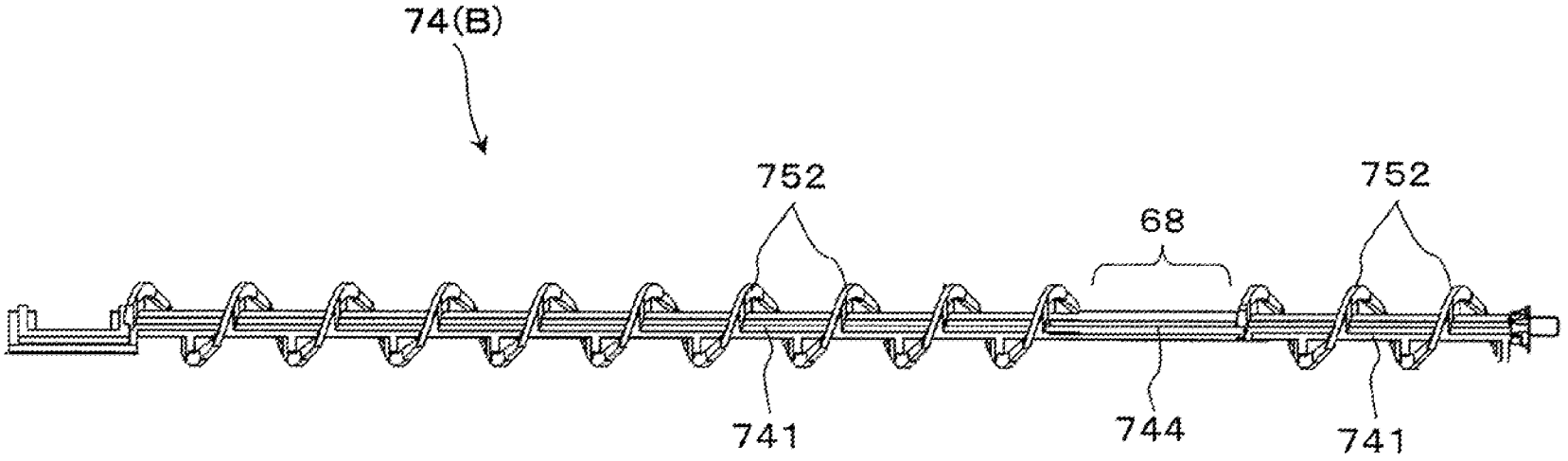
FIG. 14 is a plan view illustrating a transport unit for developer at a storage height detection position of FIGS. 13A and 13B.

As illustrated in FIG. 14, in the first transport unit 74(B) in the storage height detection device 6, instead of the eccentric shaft 743, a non-eccentric shaft 744 is used as the rotational shaft of the non-transport portion 68, the non-eccentric shaft 744 having no displacement from the shaft center of the rotational shaft 741 in the portion other than the non-transport portion 68.

As illustrated in FIGS. 13A and 13B, the swinging unit 64(D) in the storage height detection device 6 is formed in a shape which crosses over the non-eccentric shaft 744 in the non-transport portion 68 and reaches the position of the lowest detection height MLow for the surface (S) of the developer.

The swinging unit 64(D) in the third exemplary embodiment is in a shape having a first part 64*d* from the swing support shaft 66 to the non-eccentric shaft 744; a second part 64*m* crossing over the non-eccentric shaft 744 and including the swing leading end 64*a*; and a curved part 64*h* provided between the first part 64*d* and the second part 64*m*. The first part 64*d* and the second part 64*m* are each formed of a member in a cylindrical exterior shape. The curved part 64*h* is formed of a member in an inverted U-shape which detours and crosses over the non-eccentric shaft 744.

In the case where the swinging unit 64(D) in such a shape is used, as illustrated in FIG. 13B, when the developer in the first transport path 72A is reduced with the developer surface close to the lowest detection height MLow, and the swinging unit 64(D) follows the storage height of the surface (S) of the developer and swings in the direction in which the swing leading end 64*a* is lowered, the curved part 64*h* does not come into contact with the non-eccentric shaft 744 of the non-transport portion 68 of the first transport unit 74(B), and the swing leading end 64*a* of the second part 64*m* comes into contact with the surface (S) of the developer in reduced volume with the developer surface close to the lowest detection height MLow, thus the storage height can be detected.

In the storage height detection device 6, the swinging unit 64(D) in a curved shape crossing over the non-eccentric shaft 744 swings by following at least the storage height of the surface (S) of the developer stored in the portion (hereinafter simply referred to as the "detection area"), where the non-transport portion 68 in the first transport unit 74(B) is present, of the first transport path 72A, and the detection unit 65 detects a state of swinging of the swinging unit 64(D).

It is to be noted that in the storage height detection device 6, the non-eccentric shaft 744 is used as the rotational shaft of the non-transport portion 68, thus for instance when developer is not present in the first transport path 72A or when the developer is reduced, as illustrated in FIG. 13B, the lower portion of the curved part 64*h* may come into contact with the outermost circumferential portion of the non-eccentric shaft 744 in the first transport unit 74(B) in rotation, and may assume a state of swinging.

For instance, in a stage where a sufficient amount of developer is stored in the detection area in the first transport path 72A, the swinging unit 64(D) operates in the following manner to detect the storage height of the developer.

Specifically, in a stage where a sufficient amount of developer is present, as illustrated in FIG. 13A, the swing leading end 64*a* of the second part 64*m* assumes a state of swinging to a position to come into contact with the surface (S) of the developer regardless of the position of the non-eccentric shaft 744 of the non-transport portion 68 rotating in the detection area in the first transport unit 74(B).

In this stage, the lower portion of the curved part 64*h* does not come into contact with the non-eccentric shaft 744 of the non-transport portion 68 in the first transport unit 74(B) in rotation until the storage height of the developer reaches a certain low height.

Figure 15:
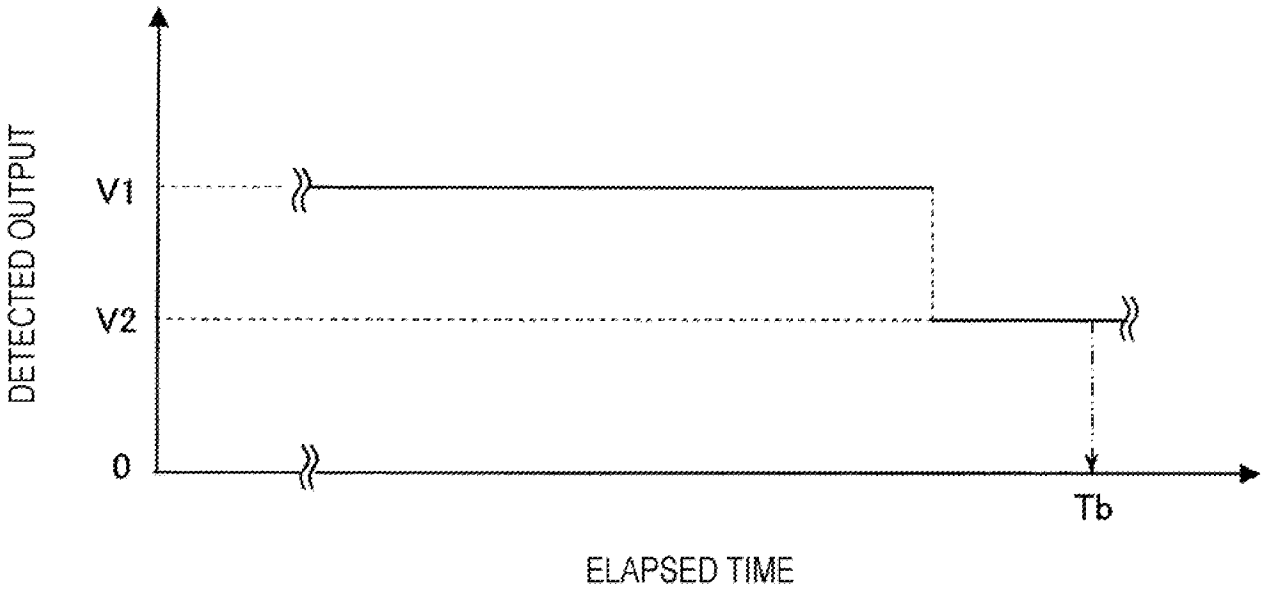
FIG. 15 is a conceptual graph illustrating an example of a detection output of a detection unit in the third exemplary embodiment.

In this process, as illustrated in FIG. 13A, the detected plate 67, which swings in coordination with the swinging unit 64(D), assumes a state of swinging to a position to block the detection light of the detector 65*a* of the detection unit 65. As illustrated in FIG. 15, the detection output of the detection unit 65 at this point is obtained as a predetermined first output value (V1).

In the storage height detection device 6 (or the control unit 15), it is set that the detection output of the detection unit 65 at this point is regarded as detection information indicating that "developer is present".

In contrast, in a stage where the developer stored in the detection area of the first transport path 72A is gradually reduced due to a replenishment operation, the swinging unit 64(D) assumes the state as described below.

Specifically, in the stage where the developer is reduced, the storage height of the surface (S) of the developer starts to decrease relatively, the swinging unit 64(D) with the swing leading end 64*a* in contact with the surface (S) assumes a state of starting to swing in the direction in which the swing leading end 64*a* is lowered.

In this process, when the storage height of the developer is reduced to a height closer to the lowest detection height MLow, as illustrated in FIG. 13B, the detected plate 67 which swings in coordination with the swinging unit 64(D) assumes a state of swinging to a position not to block the detection light of the detector 65*a* of the detection unit 65. As illustrated in FIG. 15, the detection output of the detection unit 65 at this point is obtained as a predetermined second output value (V2).

In this process, in the swinging unit 64(D), the lower portion of the curved part 64*h* may be configured to come into contact with the outermost circumferential portion of the non-eccentric shaft 744 rotating in the detection area in the first transport unit 74(B) and assume a state of swinging.

However, even when the state of swinging is assumed, in almost all cases, the swinging unit 64(D) is not caused to swing in the direction in which the swing leading end 64*a* is raised. Thus, as illustrated in FIG. 13B, the detected plate 67 at this point assumes a state of remaining at a position not to block the detection light of the detector 65*a* of the detection unit 65. As illustrated in FIG. 15, the detection output of the detection unit 65 at this point remains at the second output value (V2).

In the storage height detection device 6 (or the control unit 15), it is set that, for instance, when the detection output of the detection unit 65 changes from the first output value (V1) to the second output value (V2), and a time point (Tb) is reached after a predetermined time has elapsed as illustrated in FIG. 15, the detection output is regarded as detection information indicating that "developer is in shortage or not present".

Therefore, the storage height detection device 6 provides the same effect as that of the storage height detection device 6 according to the first exemplary embodiment. In particular, detection is performed in the detection area, where the non-transport portion 68 in the first transport unit 74(B) is present, of the first transport path 72A without interference of the non-eccentric shaft 744 with the transport of the developer.

[Modifications]

The present disclosure is not limited to the contents illustrated in the first to third exemplary embodiments, and, for instance, may include the modifications described below.

In the first to third exemplary embodiments, a configuration example has been shown, in which the developer storage height detection device 6 is applied to the storage height detection device in the developer replenishing device 7 of the image forming apparatus 1. However, the storage height detection device 6 of the present disclosure may be applied to another device component that uses developer by transporting the developer.

For instance, in an image forming apparatus that forms an image formed of developer, when a configuration component includes a main body that has a transport path along which developer is transported; a developer transport unit that is disposed to rotate in the transport path and includes a transporter provided spirally around a rotational shaft; and a storage height detection device that detects the storage height of a surface of developer transported in the transport path, the storage height detection device can be formed of the storage height detection device 6 of the present disclosure.

In the first exemplary embodiment, a member including the contact portion 64, in a cylindrical exterior shape as a whole has been illustrated as the swinging unit 64. However, as the swinging unit 64, a portion (portion also including the upper portion 64*k*) including the contact portion 64*j* may be formed in a spherical exterior shape.

In the storage height detection device 6 which uses the swinging unit 64 including such contact portion 64*j*, in a spherical exterior shape, as compared with when the swinging unit 64 is not formed in such a manner, the storage height can be detected while the swinging unit 64 follows the surface (S) of the developer with less friction against the transport flow of the developer in the first transport path 72A.

In the second exemplary embodiment, the case has been illustrated where the rotational part 641 is formed of a member in a cylindrical exterior shape, and any cross section perpendicular to the rotational part 641 has a circular shape. However, the rotational part 641 may be formed of a member such as a sphere or a tube so that the cross section has a circular shape.

In the third exemplary embodiment, the example has been illustrated where the second part 64*m* including the swing leading end 64*a* of the swinging unit 64(D) is formed as the rotational part 641 in a cylindrical exterior shape. However, a swinging unit having a rotational part formed of a member such as a sphere, a tube may be used as the swinging unit 64(D) so that any cross section, perpendicular to the rotational support shaft 642, of the rotational part 641 has a circular shape.

In addition, in the third exemplary embodiment, the second part 64*m* in the swinging unit 64(D) may be changed to the rotational part 641 (FIGS. 11A and 11B) in the second exemplary embodiment or the rotational part 641 (FIGS. 12A and 12B) having the projections 645 in the third exemplary embodiment.

An apparatus in another form or type may be used as the image forming apparatus 1.

It is to be noted that the "developer" in the exemplary embodiments described above is an example of the "powder" in the present disclosure, and powder other than the developer is applicable to the present disclosure. In addition, although examples have been shown which are applied to an image forming apparatus that forms an electrostatic charge pattern on a photoreceptor in the above-described exemplary embodiments, the examples may be applied to an apparatus that does not form an electrostatic charge pattern.

For instance, a powder coating apparatus may be formed by utilizing coating powder instead of the developer. Specifically, a powder coating head in an electrostatic powder coating system is utilized instead of the developing device 24 in each exemplary embodiment, and a conductive sheet-like medium is transported in the vicinity of the powder coating head. A bias voltage is applied across the powder coating head and the conductive sheet-like medium, thus charged coating powder (for instance, thermosetting toner) is coated on the sheet-like medium. Subsequently, heating the sheet-like medium produces a surface coated with the sheet-like medium.

Alternatively, the disclosure is applicable to other manufacturing apparatuses that use powder. For instance, in a manufacturing apparatus that manufactures an electrode body of a secondary battery, the disclosure may be applied to a device that detects a storage height of powder such as carbon black used for manufacturing, or a carbon black replenishing device.

In addition, the application of powder is not limited to powder for chemicals or powder for food, and the type of a device is not limited as long as the device uses powder, such as a manufacturing device, a processing device, and an inspection device.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder storage height detection device comprising:

a main body that has a transport path configured to transport powder;

a powder transport unit configured to rotate in the transport path, wherein the powder transport unit includes a transporter provided spirally around a rotational shaft;

a swinging unit configured to contact a surface of the powder transported in the transport path, and configured to swing by following at least a storage height of the surface; and a detection unit configured to detect a state of swinging of the swinging unit, wherein the powder transport unit includes a non-transport portion in which the transporter is not present, wherein the swinging unit is configured to swing in the non-transport portion, wherein the swinging unit comprises an upper portion located above a contact portion configured to contact the powder, and wherein the upper portion comprises an upward convex curved surface.

2. The powder storage height detection device according to claim 1, wherein the contact portion comprises a downward convex curved surface.

3. The powder storage height detection device according to claim 2, wherein a portion of the swinging unit is formed in a cylindrical exterior shape, and wherein the portion of the swinging unit includes at least the contact portion.

4. The powder storage height detection device according to claim 3, wherein a portion of the swinging unit is formed in a hollow structure, and wherein the portion of the swinging unit includes at least the contact portion.

5. The powder storage height detection device according to claim 2, wherein a portion of the swinging unit is formed in a spherical exterior shape, and wherein the portion of the swinging unit includes at least the contact portion.

6. The powder storage height detection device according to claim 5, wherein a portion of the swinging unit is formed in a hollow structure, and wherein the portion of the swinging unit includes at least the contact portion.

7. The powder storage height detection device according to claim 2, wherein a portion of the swinging unit is formed in a hollow structure, and wherein the portion of the swinging unit includes at least the contact portion.

8. The powder storage height detection device according to claim 1, wherein a portion of the swinging unit is formed in a cylindrical exterior shape, and wherein the portion of the swinging unit includes at least the contact portion.

9. The powder storage height detection device according to claim 8, wherein a portion of the swinging unit is formed in a hollow structure, and wherein the portion of the swinging unit includes at least the contact portion.

10. The powder storage height detection device according to claim 1, wherein a portion of the swinging unit is formed in a spherical exterior shape, and wherein the portion of the swinging unit includes at least the contact portion.

11. The powder storage height detection device according to claim 10, wherein a portion of the swinging unit is formed in a hollow structure, and wherein the portion of the swinging unit includes at least the contact portion.

12. The powder storage height detection device according to claim 1, wherein a portion of the swinging unit is formed in a hollow structure, and wherein the portion of the swinging unit includes at least the contact portion.

13. The powder storage height detection device according to claim 1, wherein a portion of the swinging unit including the contact portion is rotatably formed to follow movement of the powder transported in the transport path.

14. The powder storage height detection device according to claim 13, wherein the portion of the swinging unit including the contact portion is rotatably mounted on a shaft in structure, and wherein a cross section of the portion of the swinging unit has a circular shape, the cross section being perpendicular to the shaft.

15. The powder storage height detection device according to claim 14, wherein the portion of the swinging unit including the contact portion is formed in a shape having projections that follow a transport flow of the powder and promote rotation.

16. The powder storage height detection device according to claim 13, wherein the portion of the swinging unit including the contact portion is formed in a shape having projections that follow a transport flow of developer and promote rotation.

17. The powder storage height detection device according to claim 1, wherein the non-transport portion is formed as an eccentric shaft having a shaft center displaced from the rotational shaft.

18. A powder replenishing device comprising:

a main body including:

a receiving port configured to receive powder supplied from a powder container;

a transport path configured to transport the powder; and a delivery port configured to deliver the powder in the transport path to a replenishment destination;

a powder transport unit configured to rotate in the transport path and includes a transporter provided spirally around a rotational shaft;

a delivery unit configured to deliver the powder in the transport path to the delivery port; and a storage height detection device configured to detect a storage height of a surface of the powder transported in the transport path, wherein the storage height detection device is the powder storage height detection device according to claim 1.

19. A powder storage height detection device comprising:

a main body that has a transport path configured to transport powder;

a powder transporter comprising a projection provided spirally around a rotational shaft, wherein the powder transporter is configured to rotate in the transport path;

a cylinder configured to contact a surface of the powder transported in the transport path, and configured to swing by following at least a storage height of the surface; and a photosensor configured to detect a state of swinging of the cylinder, wherein the powder transporter includes a non-transport portion in which the projection is not present, wherein the cylinder is configured to swing in the non-transport portion, wherein the cylinder comprises an upper portion located above a contact portion configured to contact the powder, and wherein the upper portion comprises an upward convex curved surface.

* * * * *